US009728200B2

(12) United States Patent
Atti et al.

(10) Patent No.: US 9,728,200 B2
(45) Date of Patent: Aug. 8, 2017

(54) SYSTEMS, METHODS, APPARATUS, AND COMPUTER-READABLE MEDIA FOR ADAPTIVE FORMANT SHARPENING IN LINEAR PREDICTION CODING

(71) Applicant: QUALCOMM Incorporated, San Diego, CA (US)

(72) Inventors: Venkatraman S. Atti, San Diego, CA (US); Vivek Rajendran, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 321 days.

(21) Appl. No.: 14/026,765

(22) Filed: Sep. 13, 2013

(65) Prior Publication Data

US 2014/0214413 A1 Jul. 31, 2014

Related U.S. Application Data

(60) Provisional application No. 61/758,152, filed on Jan. 29, 2013.

(51) Int. Cl.
*G10L 19/26* (2013.01)

(52) U.S. Cl.
CPC ..... *G10L 19/26* (2013.01)

(58) Field of Classification Search
CPC ..... G10L 19/26
USPC ..... 704/209
See application file for complete search history.

(56) References Cited

U.S. PATENT DOCUMENTS

| | | | | |
|---|---|---|---|---|
| 5,845,244 | A | 12/1998 | Proust | |
| 6,141,638 | A | 10/2000 | Peng et al. | |
| 6,449,313 | B1 | 9/2002 | Erzin et al. | |
| 6,629,068 | B1 | 9/2003 | Horos et al. | |
| 6,704,701 | B1 | 3/2004 | Gao | |
| 6,766,289 | B2 | 7/2004 | Kandhadai et al. | |
| 6,795,805 | B1 | 9/2004 | Bessette et al. | |
| 7,117,146 | B2 | 10/2006 | Gao | |
| 7,272,556 | B1 * | 9/2007 | Aguilar | G10L 19/093 704/201 |
| 7,676,362 | B2 * | 3/2010 | Boillot | G10L 19/26 704/205 |

(Continued)

FOREIGN PATENT DOCUMENTS

| | | | |
|---|---|---|---|
| EP | 0747883 | A2 | 12/1996 |
| WO | 0223536 | A2 | 3/2002 |
| WO | 2005041170 | A1 | 5/2005 |

OTHER PUBLICATIONS

Blamey, et al., "Formant-Based Processing for Hearing Aids," Human Communication Research Centre, University of Melbourne, pp. 273-pp. 278, Jan. 1993.

(Continued)

*Primary Examiner* — Susan McFadden
(74) *Attorney, Agent, or Firm* — Toler Law Group, PC

(57) ABSTRACT

A method of processing an audio signal includes determining an average signal-to-noise ratio for the audio signal over time. The method includes, based on the determined average signal-to-noise ratio, a formant-sharpening factor is determined. The method also includes applying a filter that is based on the determined formant-sharpening factor to a codebook vector that is based on information from the audio signal.

99 Claims, 15 Drawing Sheets

(56) References Cited

U.S. PATENT DOCUMENTS

| | | | |
|---|---|---|---|
| 7,788,091 | B2 | 8/2010 | Goudar et al. |
| 9,047,865 | B2 * | 6/2015 | Aguilar ..... G10L 19/093 |
| 2002/0116182 | A1 | 8/2002 | Gao et al. |
| 2002/0147583 | A1 | 10/2002 | Gao |
| 2004/0093205 | A1 | 5/2004 | Ashley et al. |
| 2010/0332223 | A1 | 12/2010 | Morii et al. |
| 2012/0095757 | A1 | 4/2012 | Gibbs et al. |
| 2012/0323571 | A1 | 12/2012 | Song et al. |

OTHER PUBLICATIONS

Boillot, et al., "A Loudness Enhancement Technique for Speech," IEEE, 0-7803-8251-X/04, ISCAS 2004, pp. V-616-V-619, 2004.

Cheveigne, Alain de, "Formant Bandwidth Affects the Identification of Competing Vowels," CNRS-IRCAM, France, and ATR-HIP, Japan, pp. 1-4, 1999.

Coelho, et al., "Voice Pleasantness: on the Improvement of TTS Voice Quality," Instituto Politécnico do Porto, ESEIG, Porto, Portugal, MLDC—Microsoft Language Development Center, Lisbon, Portugal, Universidade de Vigo, Dep. Teoria de la Señal e Telecomuniçõns, Vigo, Spain, p. 1-p. 6, viewed Aug. 13, 2013 at http://jth2008.ehu.es/cd/pdfs/articulo/art_52.pdf.

Cole, et al., "Speech Enhancement by Formant Sharpening in the CEPSTRAL Domain," Proceedings of the 9th Australian International Conference on Speech Science & Technology, Australian Speech Science & Technology Association Inc., pp. 244-249, Melbourne, Australia, Dec. 2-5, 2002.

Cox, "Current Methods of Speech Coding," Signal Compression: Coding of Speech, Audio, Text, Image and Video, ed. N. Jayant, ISBN-13: 9789810237653, vol. 7, No. 1, pp. 31-39, 1997.

ISO/IEC 14496-3:2005(E), Subpart 3: Speech Coding—CELP, pp. 1-165, 2005.

ITU-T, "Series G: Transmission Systems and Media, Digital Systems and Networks, Digital terminal equipment—Coding of analogue signals by methods other than PCM, Dual rate speech coder for multimedia communications transmitting at 5.3 and 6.3 kbit/s", G.723.1, ITU-T, pp. 1-64, May 2006.

Jokinen, et al., "Comparison of Post-Filtering Methods for Intelligibility Enhancement of Telephone Speech," 20th European Signal Processing Conference (EUSIPCO 2012), ISSN 2076-1465, p. 2333-p. 2337, Bucharest, Romania, Aug. 27-31, 2012.

Taniguchi, et al., "Pitch Sharpening for Perceptually Improved CELP, and the Sparse-Delta Codebook for Reduced Computation", Proceedings from the International Conference on Acoustics, Speech & Signal Processing, ICASSP, pp. 241-244, Apr. 14-17, 1991.

Zorila, et al., "Improving Speech Intelligibility in Noise Environments by Spectral Shaping and Dynamic Range Compression", The Listening Talker—An interdisciplinary Workshop on Natural and Synthetic Modification of Speech, LISTA Workshop in Response to listening conditions. Edinburgh, May 2-3, 2012, pp. 1.

Zorila, et al., "Improving Speech Intelligibility in Noise Environements by Spectral Shaping and Dynamic Range Compression," FORTH—Institute of Computer Science, Listening Talker, pp. 1.

Zorila, et al., "Speech-in-Noise Intelligibility Improvement Based on Power Recovery and Dynamic Range Compression," 20th European Signal Processing Conference (EUSIPCO 2012), ISSN 2076-1465, pp. 2075-pp. 2079, Bucharest, Romania, Aug. 27-31, 2012.

Erzin E, "Shaped Fixed Codebook Search for CELP Coding at Low Bit Rates", Proceedings 2000 IEEE International Conference on Acoustics, Speech, and Signal Processing, 2000, ICASSP '00, NJ, USA, vol. 3, pp. 1495-1497.

International Search Report and Written Opinion for International Application No. PCT/US2013/077421, ISA/EPO, Date of Mailing Oct. 8, 2014, 14 pages.

* cited by examiner

```
/* Current frame's instantaneous energy */
        FS_tmp_Ener = sum_of_all_elements(square(synthesized_frame));

/* Current frame's instantaneous energy in log domain */
        FS_tmp_Ener = 10.0f * (float)log10(FS_tmp_Ener);

/* If the frame is an inactive frame, update the long-term noise
estimate, else update the long-term frame energy estimate */
        if(coder_type == INACTIVE)
            FS_ltNsEner = 0.99f * FS_ltNsEner + 0.01f * FS_tmp_Ener;
        else
            FS_ltSpEner = 0.99f * FS_ltSpEner + 0.01f * FS_tmp_Ener;

/* Compute long-term SNR in log domain */
        FS_ltSNR = FS_ltSpEner - FS_ltNsEner;
```

*FIG. 4*

```
/* Initialize the GAMMA_2 and SNR boundary values */
      GAMMA2MIN = 0.75;
      GAMMA2MAX = 0.9;
      SNR1 = 10;
      SNR2 = 30;

/* Estimate the FS slope and FS offset */
      FS_SNR_SLOPE = (GAMMA2MAX - GAMMA2MIN)/(SNR2 - SNR1);
      FS_SNR_OFFSET = (GAMMA2MIN - FS_SNR_SLOPE * SNR1);

/* Estimate the formant-sharpening factor */
      GAMMA_2 = FS_SNR_SLOPE * FS_ltSNR + FS_SNR_OFFSET
```

*FIG. 5*

SYSTEMS, METHODS, APPARATUS, AND COMPUTER-READABLE MEDIA FOR ADAPTIVE FORMANT SHARPENING IN LINEAR PREDICTION CODING

CROSS-REFERENCE TO RELATED APPLICATIONS

The present application claims priority from commonly owned U.S. Provisional Patent Application No. 61/758,152 filed on Jan. 29, 2013, the content of which is expressly incorporated herein by reference in its entirety.

FIELD

This disclosure relates to coding of audio signals (e.g., speech coding).

DESCRIPTION OF RELATED ART

The linear prediction (LP) analysis-synthesis framework has been successful for speech coding because it fits well the source-system paradigm for speech synthesis. In particular, the slowly time-varying spectral characteristics of the upper vocal tract are modeled by an all-pole filter, while the prediction residual captures the voiced, unvoiced, or mixed excitation behavior of the vocal chords. The prediction residual from the LP analysis is modeled and encoded using a closed-loop analysis-by-synthesis process.

In analysis-by-synthesis code excited linear prediction (CELP) systems, the excitation sequence that results in the lowest observed "perceptually-weighted" mean-square-error (MSE) between the input and reconstructed speech is selected. The perceptual weighting filter shapes the prediction error such that quantization noise is masked by the high-energy formants. The role of perceptual weighting filters is to de-emphasize the error energy in the formant regions. This de-emphasis strategy is based on the fact that in the formant regions, quantization noise is partially masked by speech. In CELP coding, the excitation signal is generated from two codebooks, namely, the adaptive codebook (ACB) and the fixed codebook (FCB). The ACB vector represents a delayed (i.e., by closed-loop pitch value) segment of the past excitation signal and contributes to the periodic component of the overall excitation. After the periodic contribution in the overall excitation is captured, a fixed codebook search is performed. The FCB excitation vector partly represents the remaining aperiodic component in the excitation signal and is constructed using an algebraic codebook of interleaved, unitary-pulses. In speech coding, pitch- and formant-sharpening techniques provide significant improvement to the speech reconstruction quality, for example, at lower bit rates.

Formant sharpening may contribute to significant quality gains in clean speech; however, in the presence of noise and at low signal-to-noise ratios (SNRs), the quality gains are less pronounced. This may be due to inaccurate estimation of the formant sharpening filter and partly due to certain limitations of the source-system speech model that additionally needs to account for noise. In some cases, the degradation in speech quality is more noticeable in the presence of bandwidth extension where a transformed, formant sharpened low band excitation is used in the high band synthesis. In particular, certain components (e.g., the fixed codebook contribution) of the low band excitation may undergo pitch- and/or formant-sharpening to improve the perceptual quality of low-band synthesis. Using the pitch- and/or formant-sharpened excitation from low band for high band synthesis may have higher likelihood to cause audible artifacts than to improve the overall speech reconstruction quality.

BRIEF DESCRIPTION OF THE DRAWINGS

FIG. 4 shows an example of a pseudocode listing for computing a long-term SNR.

FIG. 5 shows an example of a pseudocode listing for estimating a formant-sharpening factor according to the long-term SNR.

DETAILED DESCRIPTION

Figure 1:
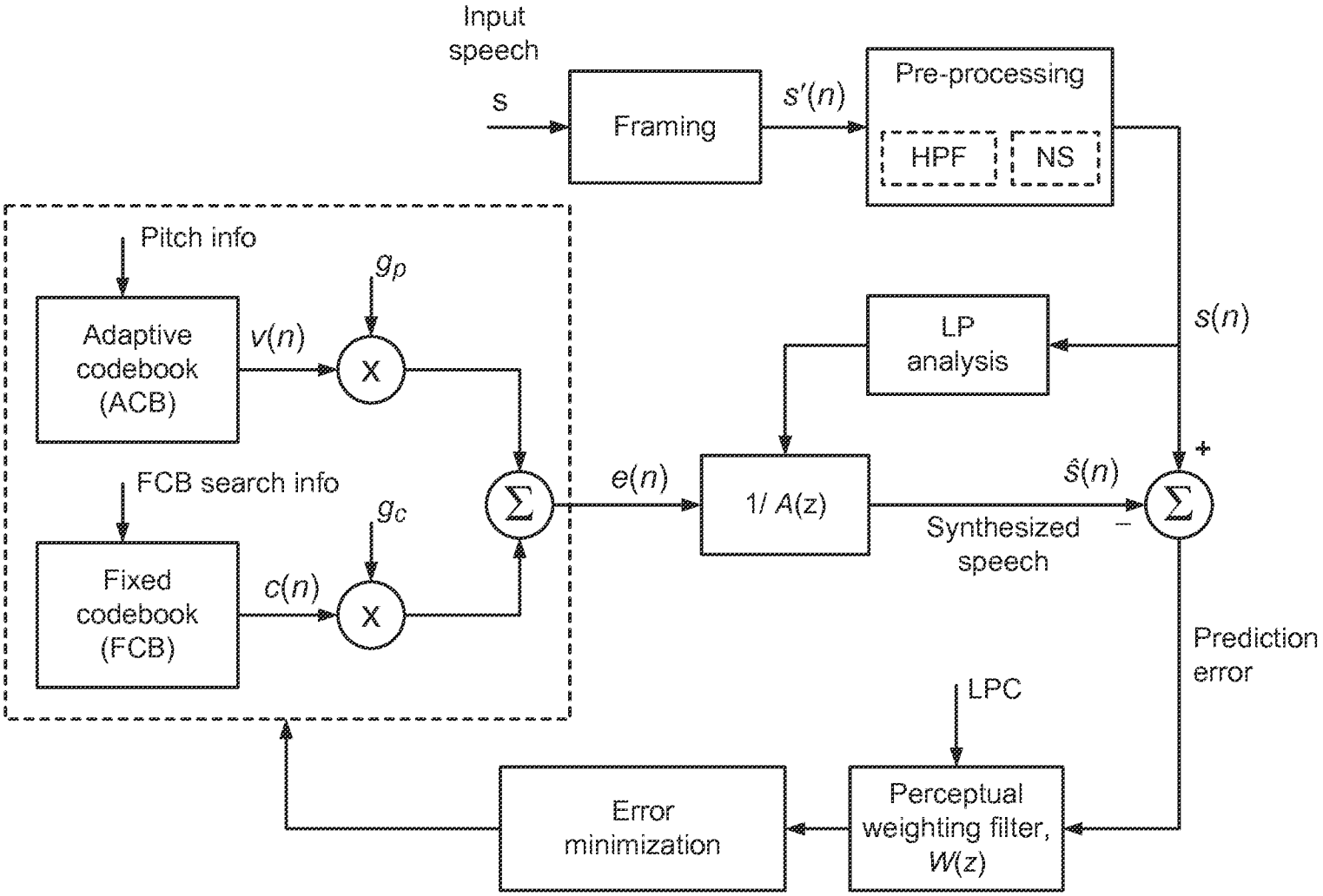
FIG. 1 shows a schematic diagram for a code-excited linear prediction (CELP) analysis-by-synthesis architecture for low-bit-rate speech coding.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Unless expressly limited by its context, the term "determining" is used to indicate any of its ordinary meanings, such as deciding, establishing, concluding, calculating, selecting, and/or evaluating. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency-domain representation of the signal (e.g., as produced by a fast Fourier transform or MDCT) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. A "task" having multiple subtasks is also a method. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." The term "plurality" means "two or more." Any incorporation by reference of a portion of a document shall also be understood to incorporate definitions of terms or variables that are referenced within the portion, where such definitions appear elsewhere in the document, as well as any figures referenced in the incorporated portion.

The terms "coder," "codec," and "coding system" are used interchangeably to denote a system that includes at least one encoder configured to receive and encode frames of an audio signal (possibly after one or more pre-processing operations, such as a perceptual weighting and/or other filtering operation) and a corresponding decoder configured to produce decoded representations of the frames. Such an encoder and decoder are typically deployed at opposite terminals of a communications link. In order to support a full-duplex communication, instances of both of the encoder and the decoder are typically deployed at each end of such a link.

Unless otherwise indicated, the terms "vocoder," "audio coder," and "speech coder" refer to the combination of an audio encoder and a corresponding audio decoder. Unless otherwise indicated, the term "coding" indicates transfer of an audio signal via a codec, including encoding and subsequent decoding. Unless otherwise indicated, the term "transmitting" indicates propagating (e.g., a signal) into a transmission channel.

A coding scheme as described herein may be applied to code any audio signal (e.g., including non-speech audio). Alternatively, it may be desirable to use such a coding scheme only for speech. In such case, the coding scheme may be used with a classification scheme to determine the type of content of each frame of the audio signal and select a suitable coding scheme.

A coding scheme as described herein may be used as a primary codec or as a layer or stage in a multi-layer or multi-stage codec. In one such example, such a coding scheme is used to code a portion of the frequency content of an audio signal (e.g., a lowband or a highband), and another coding scheme is used to code another portion of the frequency content of the signal.

The linear prediction (LP) analysis-synthesis framework has been successful for speech coding because it fits well the source-system paradigm for speech synthesis. In particular, the slowly time-varying spectral characteristics of the upper vocal tract are modeled by an all-pole filter, while the prediction residual captures the voiced, unvoiced, or mixed excitation behavior of the vocal chords.

It may be desirable to use a closed-loop analysis-by-synthesis process to model and encode the prediction residual from the LP analysis. In an analysis-by-synthesis code-excited LP (CELP) system (e.g., as shown in FIG. 1), the excitation sequence that minimizes an error between the input and the reconstructed (or "synthesized") speech is selected. The error that is minimized in such a system may be, for example, a perceptually weighted mean-square-error (MSE).

Figure 2:
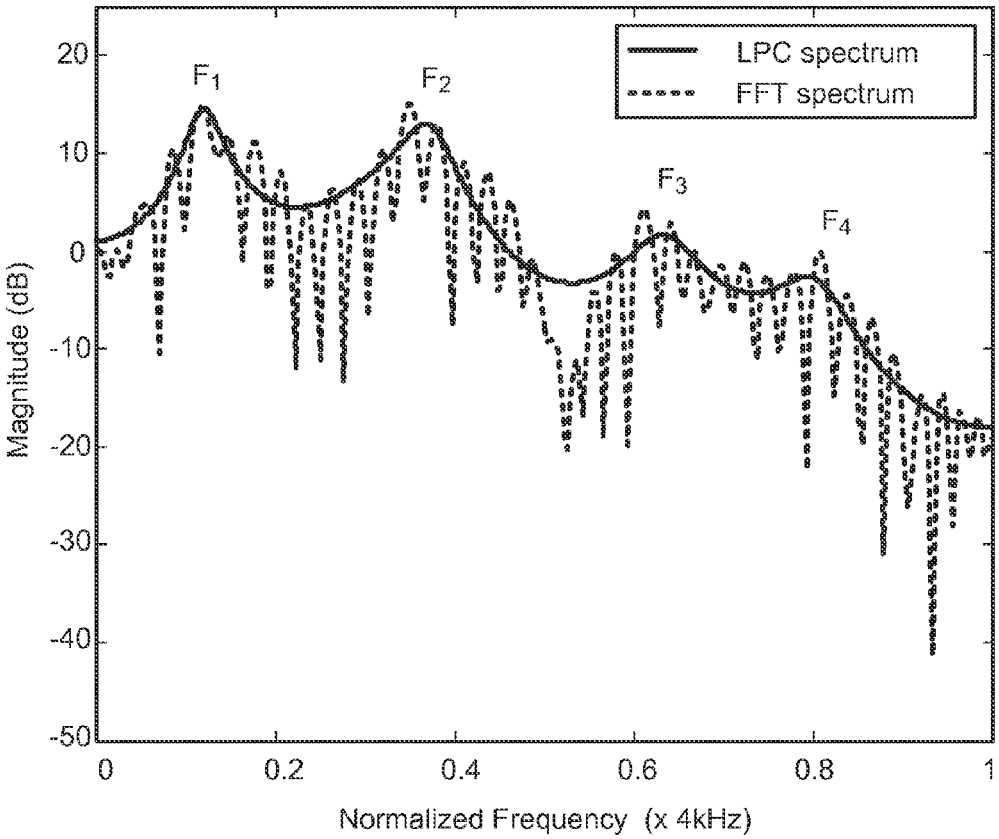
FIG. 2 shows a fast Fourier transform (FFT) spectrum and a corresponding LPC spectrum for one example of a frame of a speech signal.

FIG. 2 shows a fast Fourier transform (FFT) spectrum and a corresponding LPC spectrum for one example of a frame of a speech signal. In this example, the concentrations of energy at the formants (labeled F1 to F4), which correspond to resonances in the vocal tract, are clearly visible in the smoother LPC spectrum.

It may be expected that speech energy in the formant regions will partially mask noise that may otherwise occur in those regions. Consequently, it may be desirable to implement an LP coder to include a perceptual weighting filter (PWF) to shape the prediction error such that noise due to quantization error may be masked by the high-energy formants.

A PWF W(z) that de-emphasizes energy of the prediction error in the formant regions (e.g., such that the error outside of those regions may be modeled more accurately) may be implemented according to an expression such as $$W(z) = \frac{A(z/\gamma_1)}{A(z/\gamma_2)} = \frac{1 - \sum_{i=1}^{L} \gamma_1^i a_i z^{-i}}{1 - \sum_{i=1}^{L} \gamma_2^i a_i z^{-i}} \tag{1a}$$

or $$W(z) = \frac{A(z/\gamma_1)}{1 - \gamma_2 z^{-1}}, \tag{1b}$$

where $\gamma_1$ and $\gamma_2$ are weights whose values satisfy the relation $0<\gamma_2<\gamma_1<1$, $\alpha_1$ are the coefficients of the all-pole filter, A(z), and L is the order of the all-pole filter. Typically, the value of feedforward weight $\gamma_1$ is equal to or greater than 0.9 (e.g., in the range of from 0.94 to 0.98) and the value of feedback weight $\gamma_2$ varies between 0.4 and 0.7. As shown in expression (1a), the values of $\gamma_1$ and $\gamma_2$ may differ for different filter coefficients $\alpha_i$, or the same values of $\gamma_1$ and $\gamma_2$ may be used for all i, $1 \le i \le L$. The values of $\gamma_1$ and $\gamma_2$ may be selected, for example, according to the tilt (or flatness) characteristics associated with the LPC spectral envelope. In one example, the spectral tilt is indicated by the first reflection coefficient. A particular example in which W(z) is implemented according to expression (1b) with the values $\{\gamma_1, \gamma_2\}=\{0.92, 0.68\}$ is described in sections 4.3 and 5.3 of Technical Specification (TS) 26.190 v11.0.0 (AMR-WB speech codec, September 2012, Third Generation Partnership Project (3GPP), Valbonne, FR).

In CELP coding, the excitation signal e(n) is generated from two codebooks, namely, the adaptive codebook (ACB) and the fixed codebook (FCB). The excitation signal e(n) may be generated according to an expression such as $$e(n)=g_p v(n)+g_c c(n), \tag{2}$$

where n is a sample index, $g_p$ and $g_c$ are the ACB and FCB gains, and v(n) and c(n) are the ACB and FCB vectors, respectively. The ACB vector v(n) represents a delayed segment of the past excitation signal (i.e., delayed by a pitch value, such as a closed-loop pitch value) and contributes to the periodic component of the overall excitation. The FCB excitation vector c(n) partly represents a remaining aperiodic component in the excitation signal. In one example, the vector c(n) is constructed using an algebraic codebook of interleaved, unitary pulses. The FCB vector c(n) may be obtained by performing a fixed codebook search after the periodic contribution in the overall excitation is captured in $g_p v(n)$.

Methods, systems, and apparatus as described herein may be configured to process the audio signal as a series of segments. Typical segment lengths range from about five or ten milliseconds to about forty or fifty milliseconds, and the segments may be overlapping (e.g., with adjacent segments overlapping by 25% or 50%) or nonoverlapping. In one particular example, the audio signal is divided into a series of nonoverlapping segments or "frames", each having a length of ten milliseconds. In another particular example, each frame has a length of twenty milliseconds. Examples of sampling rates for the audio signal include (without limitation) eight, twelve, sixteen, 32, 44.1, 48, and 192 kilohertz. It may be desirable for such a method, system, or apparatus to update the LP analysis on a subframe basis (e.g., with each frame being divided into two, three, or four subframes of approximately equal size). Additionally or alternatively, it may be desirable for such a method, system, or apparatus to produce the excitation signal on a subframe basis.

FIG. 1 shows a schematic diagram for a code-excited linear prediction (CELP) analysis-by-synthesis architecture for low-bit-rate speech coding. In this figure, s is the input speech, s(n) is the pre-processed speech, $\hat{s}(n)$ is the reconstructed speech, and A(z) is the LP analysis filter.

It may be desirable to employ pitch-sharpening and/or formant-sharpening techniques, which can provide significant improvement to the speech reconstruction quality, particularly at low bit rates. Such techniques may be implemented by first applying the pitch-sharpening and formant-sharpening on the impulse response of the weighted synthesis filter (e.g., the impulse response of $W(z)\times 1/\hat{A}(z)$, where $1/\hat{A}(z)$ denotes the quantized synthesis filter), before the FCB search, and then subsequently applying the sharpening on the estimated FCB vector c(n) as described below.

1) It may be expected that the ACB vector v(n) does not capture all of the pitch energy in the signal s(n), and that the FCB search will be performed according to a remainder that includes some of the pitch energy. Consequently, it may be desirable to use the current pitch estimate (e.g., the closed-loop pitch value) to sharpen a corresponding component in the FCB vector. Pitch sharpening may be performed using a transfer function such as the following:

$$H_1(z) = \frac{1}{1 - 0.85 z^{-\tau}}, \tag{3}$$

where $\tau$ is based on a current pitch estimate (e.g., $\tau$ is the closed-loop pitch value rounded to the nearest integer value). The estimated FCB vector c(n) is filtered using such a pitch pre-filter $H_1$ (z). The filter $H_1$ (z) is also applied to the impulse response of the weighted synthesis filter (e.g., to the impulse response of $W(z)/\hat{A}(z)$) prior to FCB estimation. In another example, the filter $H_1$ (z) is based on the adaptive codebook gain $g_p$, such as in the following:

$$H_1(z) = \frac{1}{1 - 0.4 g_p z^{-\tau}}$$

(e.g., as described in section 4.12.4.14 of Third Generation Partnership Project 2 (3GPP2) document C.S0014-E v1.0, December 2011, Arlington, Va.), where the value of $g_p$ ($0 \le g_p \le 1$) may be bounded by the values [0.2, 0.9]. 2) It may also be expected that the FCB search will be performed according to a remainder that includes more energy in the formant regions, rather than being entirely noise-like. Formant sharpening (FS) may be performed using a perceptual weighting filter that is similar to the filter W(z) as described above. In this case, however, the values of the weights satisfy the relation $0<\gamma_1<\gamma_2<1$. In one such example, the values $\gamma_1=0.75$ for the feedforward weight and $\gamma_2=0.9$ for the feedback weight are used:

$$H_2(z) = \frac{A(z/0.75)}{A(z/0.9)}. \tag{4}$$

Unlike the PWF W(z) in Eq. (1) that performs the de-emphasis to hide the quantization noise in the formants, an FS filter $H_2(z)$ as shown in Eq. (4) emphasizes the formant regions associated with the FCB excitation. The estimated FCB vector c(n) is filtered using such an FS filter $H_2$ (Z). The filter $H_2$ (Z) is also applied to the impulse response of the weighted synthesis filter (e.g., to the impulse response of $W(z)/\hat{A}(z)$) prior to FCB estimation.

The improvements in speech reconstruction quality that may be obtained by using pitch and formant sharpening may directly depend on the underlying speech signal model and the accuracy in the estimation of closed-loop pitch $\tau$ and the LP analysis filter $A(z)$. Based on several large-scale listening tests, it has been experimentally verified that the formant sharpening can contribute to big quality gains in clean speech. In the presence of noise, however, some degradation has been observed consistently. Degradation caused by formant sharpening may be due to inaccurate estimation of the FS filter and/or due to limitations in the source-system speech modeling that additionally needs to account for noise.

A bandwidth extension technique may be used to increase the bandwidth of a decoded narrowband speech signal (having a bandwidth of, for example, from 0, 50, 100, 200, 300 or 350 Hertz to 3, 3.2, 3.4, 3.5, 4, 6.4, or 8 kHz) into a highband (e.g., up to 7, 8, 12, 14, 16, or 20 kHz) by spectrally extending the narrowband LPC filter coefficients to obtain highband LPC filter coefficients (alternatively, by including highband LPC filter coefficients in the encoded signal) and by spectrally extending the narrowband excitation signal (e.g., using a nonlinear function, such as absolute value or squaring) to obtain a highband excitation signal. Unfortunately, degradation caused by formant sharpening may be more severe in the presence of bandwidth extension where such a transformed lowband excitation is used in highband synthesis.

It may be desirable to preserve the quality improvements due to FS in both clean speech and noisy speech. An approach to adaptively vary the formant-sharpening (FS) factor is described herein. In particular, quality improvements were noted when using a less aggressive emphasis factor $\gamma_2$ for the formant sharpening in the presence of noise.

Figure 3A:
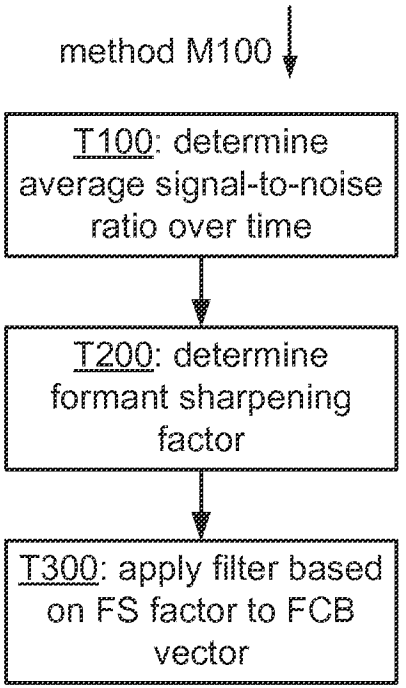
FIG. 3A shows a flowchart for a method M100 for processing an audio signal according to a general configuration.

FIG. 3A shows a flowchart for a method M100 for processing an audio signal according to a general configuration that includes tasks T100, T200, and T300. Task T100 determines (e.g., calculates) an average signal-to-noise ratio for the audio signal over time. Based on the average SNR, task T200 determines (e.g., calculates, estimates, retrieves from a look-up table, etc.) a formant sharpening factor. A "formant sharpening factor" (or "FS factor") corresponds to a parameter that may be applied in a speech coding (or decoding) system such that the system produces different formant emphasis results in response to different values of the parameter. To illustrate, a formant sharpening factor may be a filter parameter of a formant sharpening filter. For example, $\gamma_1$ and/or $\gamma_2$ of Equation 1(a), Equation 1(b), and Equation 4 are formant sharpening factors. The formant sharpening factor $\gamma_2$ may be determined based on a long-term signal to noise ratio, such as described with respect to FIGS. 5 and 6A-6C. The formant sharpening factor $\gamma_2$ may also be determined based on other factors such as voicing, coding mode, and/or pitch lag. Task T300 applies a filter that is based on the FS factor to an FCB vector that is based on information from the audio signal.

In an example embodiment, Task T100 in FIG. 3A may also include determining other intermediate factors such as voicing factor (e.g., voicing value in the range of 0.8 to 1.0 corresponds to a strongly voiced segment; voicing value in the range of 0 to 0.2 corresponds to a weakly voiced segment), coding mode (e.g., speech, music, silence, transient frame, or unvoiced frame), and pitch lag. These auxiliary parameters may be used in conjunction or in lieu of the average SNR to determine the formant sharpening factor.

Task T100 may be implemented to perform noise estimation and to calculate a long-term SNR. For example, task T100 may be implemented to track long-term noise estimates during inactive segments of the audio signal and to compute long-term signal energies during active segments of the audio signal. Whether a segment (e.g., a frame) of the audio signal is active or inactive may be indicated by another module of an encoder, such as a voice activity detector. Task T100 may then use the temporally smoothed noise and signal energy estimates to compute the long-term SNR.

FIG. 4 shows an example of a pseudocode listing for computing a long-term SNR FS_ltSNR that may be performed by task T100, where FS_ltNsEner and FS_ltSpEner denote the long-term noise energy estimate and the long-term speech energy estimate, respectively. In this example, a temporal smoothing factor having a value of 0.99 is used for both of the noise and signal energy estimates, although in general each such factor may have any desired value between zero (no smoothing) and one (no updating).

Figure 6A:
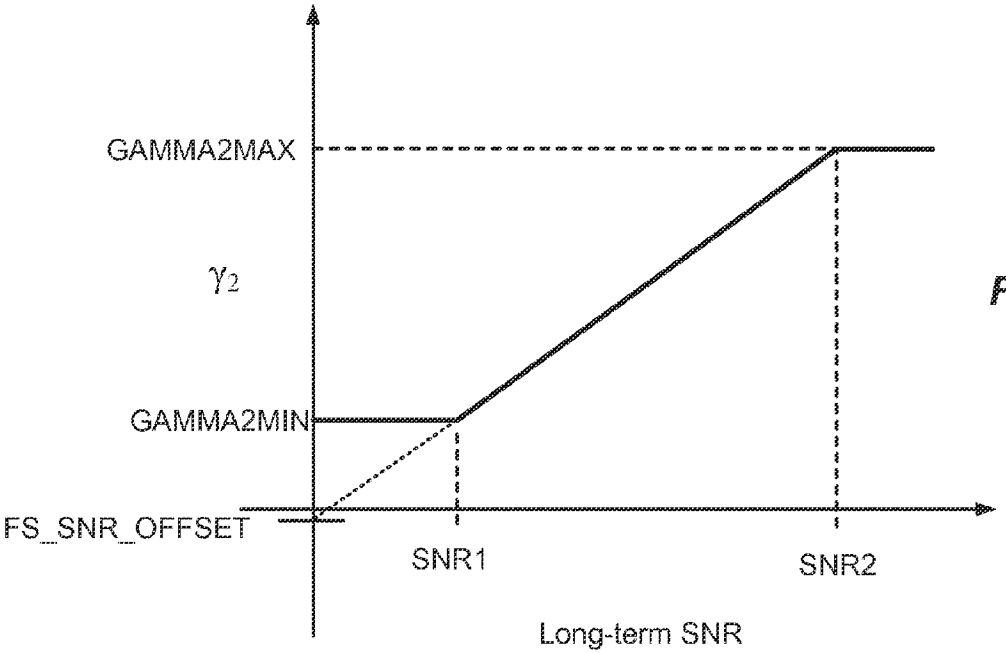
FIGS. 6A-6C are example plots of $\gamma_2$ value vs. long-term SNR.
Figure 6C:
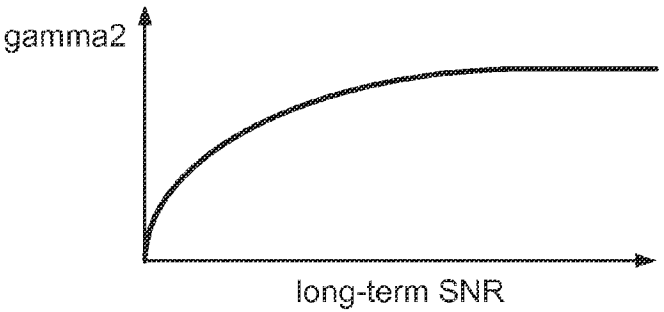

Task T200 may be implemented to adaptively vary the formant-sharpening factor over time. For example, task T200 may be implemented to use the estimated long-term SNR from the current frame to adaptively vary the formant-sharpening factor for the next frame. FIG. 5 shows an example of a pseudocode listing for estimating the FS factor according to the long-term SNR that may be performed by task T200. FIG. 6A is an example plot of $\gamma_2$ value vs. long-term SNR that illustrates some of the parameters used in the listing of FIG. 5. Task T200 may also include a subtask that clips the calculated FS factor to impose a lower limit (e.g., GAMMA2MIN) and an upper limit (e.g., GAMMA2MAX).

Figure 6B:
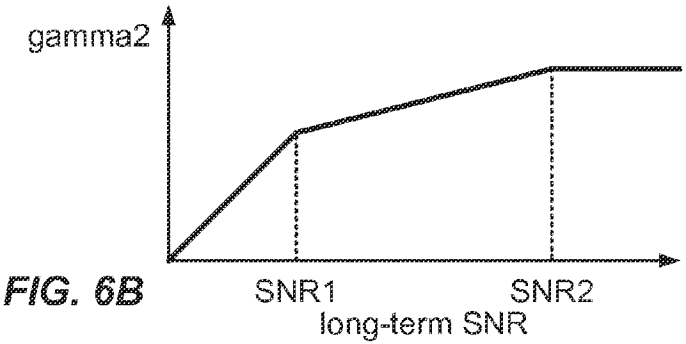

Task T200 may also be implemented to use a different mapping of $\gamma_2$ value vs. long-term SNR. Such a mapping may be piecewise linear with one, two, or more additional inflection points and different slopes between adjacent inflection points. The slope of such a mapping may be steeper for lower SNRs and more shallow at higher SNRs, as shown in the example of FIG. 6B. Alternatively, such a mapping may be a nonlinear function, such as gamma2=k*FS_ltSNR^2 or as in the example of FIG. 6C.

Task T300 applies a formant-sharpening filter on the FCB excitation, using the FS factor produced by task T200. The formant-sharpening filter $H_2(z)$ may be implemented, for example, according to an expression such as the following:

$$H_2(z) = \frac{A(z/0.75)}{A(z/\gamma_2)}.$$

Note that for clean speech and in the presence of high SNRs, the value of $\gamma_2$ is close to 0.9 in the example of FIG. 5, resulting in an aggressive formant sharpening. In low SNRs around 10-15 dB, the value of $\gamma_2$ is around 0.75-0.78, which results in no formant sharpening or less aggressive formant sharpening.

In bandwidth extension, using a formant-sharpened lowband excitation for highband synthesis may result in artifacts. An implementation of method M100 as described herein may be used to vary the FS factor such that the impact on the highband is kept negligible. Alternatively, a formant-sharpening contribution to the highband excitation may be disabled (e.g., by using the pre-sharpening version of the FCB vector in the highband excitation generation, or by disabling formant sharpening for the excitation generation in both of the narrowband and the highband). Such a method may be performed within, for example, a portable communications device, such as a cellular telephone.

Figure 3B:
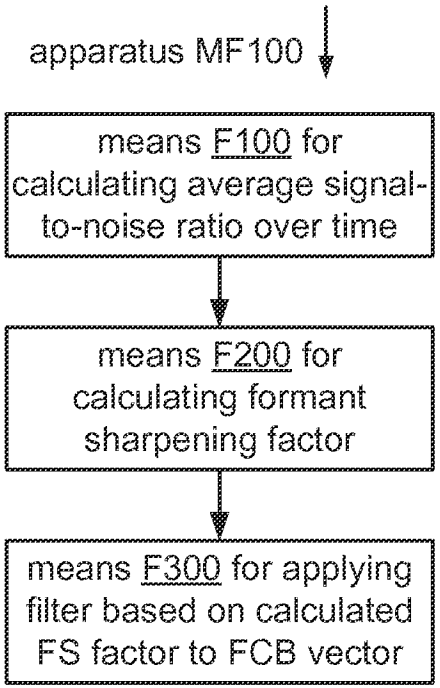
FIG. 3B shows a block diagram for an apparatus MF100 for processing an audio signal according to a general configuration.
Figure 3C:
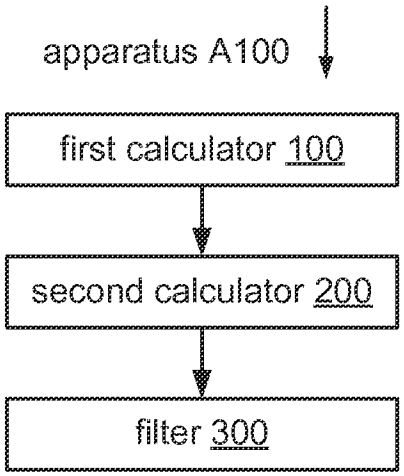
FIG. 3C shows a block diagram for an apparatus A100 for processing an audio signal according to a general configuration.
Figures 3D, 3E, 3F:
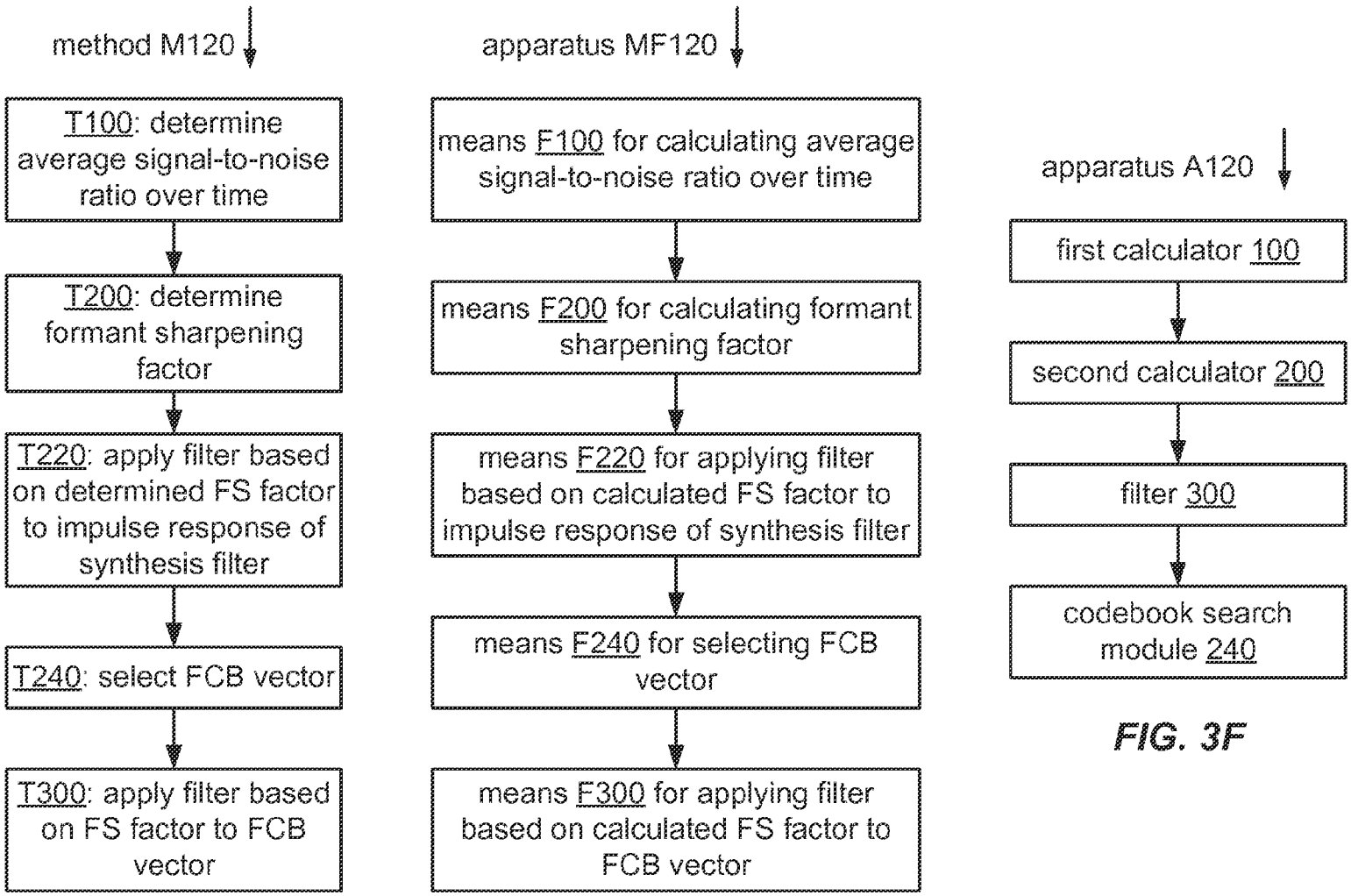
FIG. 3D shows a flowchart for an implementation M120 of method M100.
FIG. 3E shows a block diagram for an implementation MF120 of apparatus MF100.
FIG. 3F shows a block diagram for an implementation A120 of apparatus A100.

FIG. 3D shows a flowchart of an implementation M120 of method M100 that includes tasks T220 and T240. Task T220 applies a filter based on the determined FS factor (e.g., a formant-sharpening filter as described herein) to the impulse response of a synthesis filter (e.g., a weighted synthesis filter as described herein). Task T240 selects the FCB vector on which task T300 is performed. For example, task T240 may be configured to perform a codebook search (e.g., as described in FIG. 8 herein and/or in section 5.8 of 3GPP TS 26.190 v11.0.0).

FIG. 3B shows a block diagram for an apparatus MF100 for processing an audio signal according to a general configuration that includes tasks T100, T200, and T300. Apparatus MF100 includes means F100 for calculating an average signal-to-noise ratio for the audio signal over time (e.g., as described herein with reference to task T100). In an example embodiment, Apparatus MF100 may include means F100 for calculating other intermediate factors such as voicing factor (e.g., voicing value in the range of 0.8 to 1.0 corresponds to a strongly voiced segment; voicing value in the range of 0 to 0.2 corresponds to a weakly voiced segment), coding mode (e.g., speech, music, silence, transient frame, or unvoiced frame), and pitch lag. These auxiliary parameters may be used in conjunction or in lieu of the average SNR to calculate the formant sharpening factor.

Apparatus MF100 also includes means F200 for calculating a formant sharpening factor based on the calculated average SNR (e.g., as described herein with reference to task T200). Apparatus MF100 also includes means F300 for applying a filter that is based on the calculated FS factor to an FCB vector that is based on information from the audio signal (e.g., as described herein with reference to task T300). Such an apparatus may be implemented within, for example, an encoder of a portable communications device, such as a cellular telephone.

FIG. 3E shows a block diagram of an implementation MF120 of apparatus MF100 that includes means F220 for applying a filter based on the calculated FS factor to the impulse response of a synthesis filter (e.g., as described herein with reference to task T220). Apparatus MF120 also includes means F240 for selecting an FCB vector (e.g., as described herein with reference to task T240).

FIG. 3C shows a block diagram for an apparatus A100 for processing an audio signal according to a general configuration that includes a first calculator 100, a second calculator 200, and a filter 300. Calculator 100 is configured to determine (e.g., calculate) an average signal-to-noise ratio for the audio signal over time (e.g., as described herein with reference to task T100). Calculator 200 is configured to determine (e.g., calculate) a formant sharpening factor based on the calculated average SNR (e.g., as described herein with reference to task T200). Filter 300 is based on the calculated FS factor and is arranged to filter an FCB vector that is based on information from the audio signal (e.g., as described herein with reference to task T300). Such an apparatus may be implemented within, for example, an encoder of a portable communications device, such as a cellular telephone.

FIG. 3F shows a block diagram of an implementation A120 of apparatus A100 in which filter 300 is arranged to filter the impulse response of a synthesis filter (e.g., as described herein with reference to task T220). Apparatus A120 also includes a codebook search module 240 configured to select an FCB vector (e.g., as described herein with reference to task T240).

Figure 7:
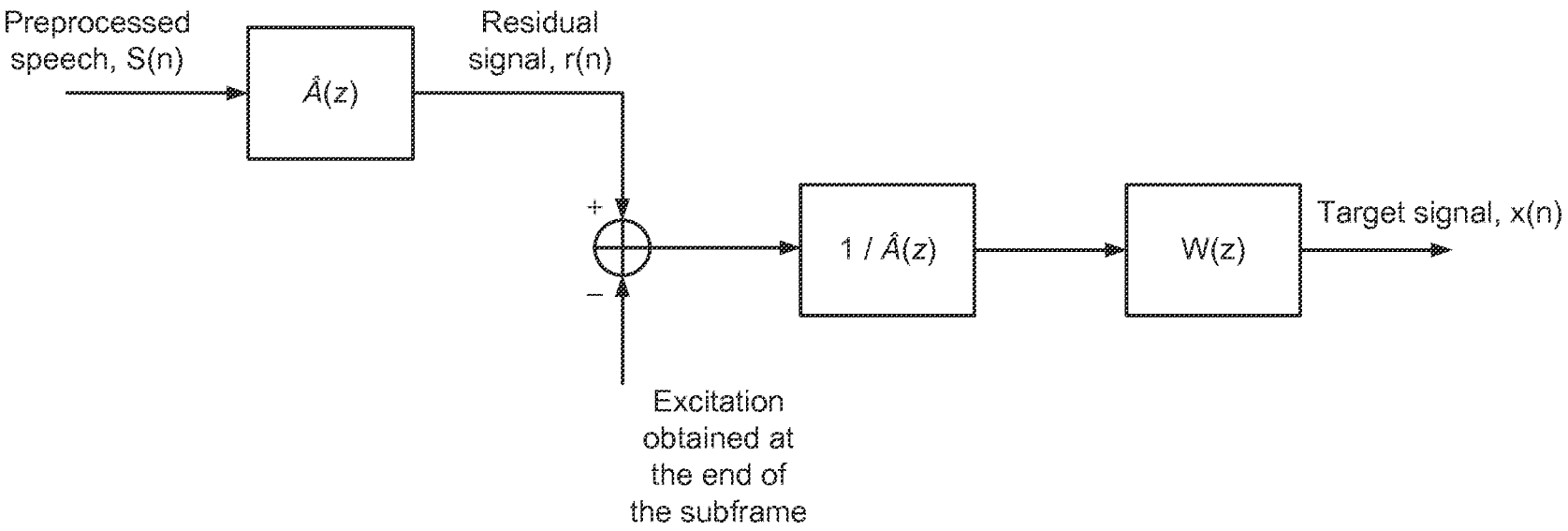
FIG. 7 illustrates generation of a target signal x(n) for adaptive codebook search.
Figure 8:
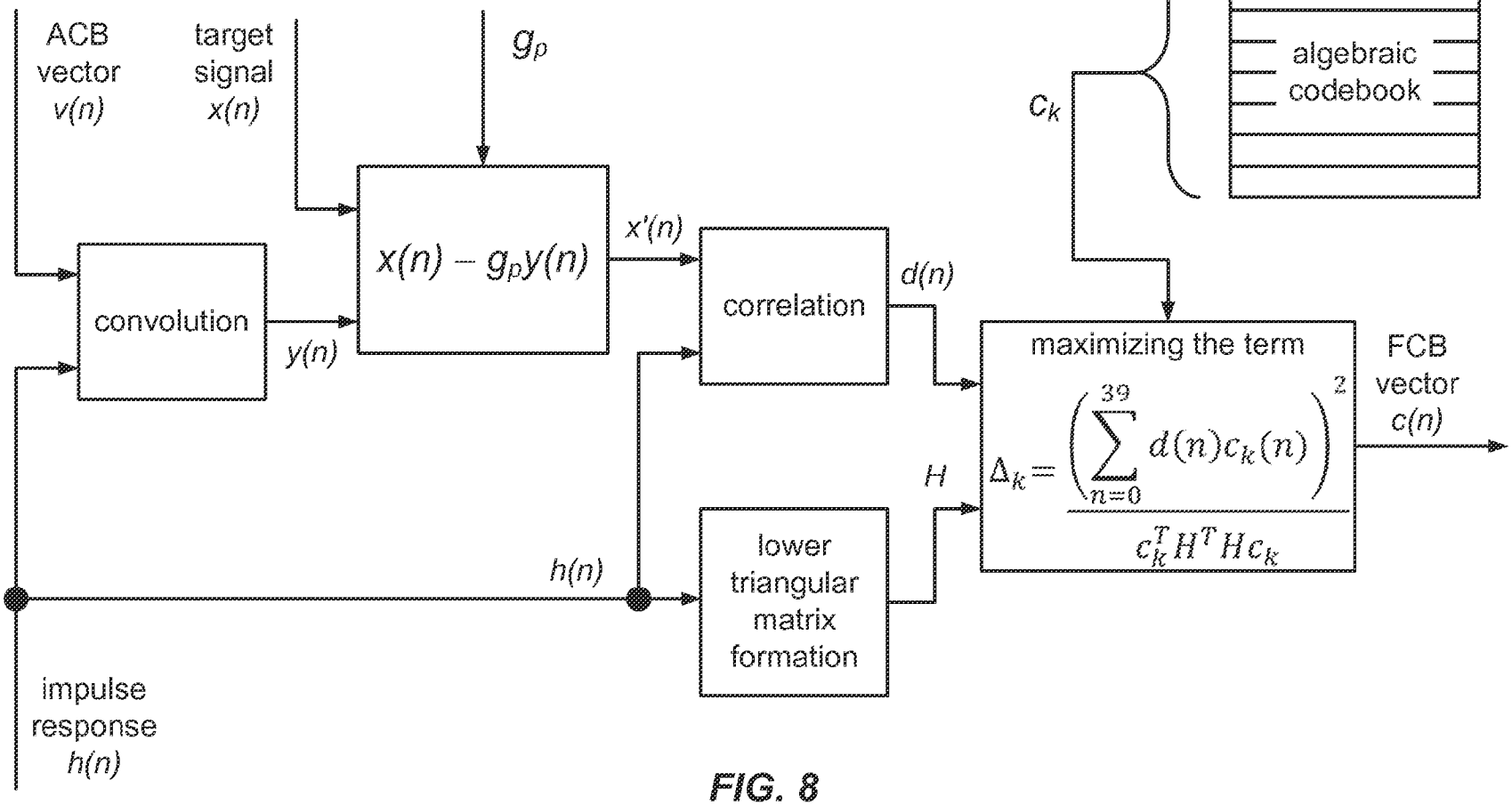
FIG. 8 shows a method for FCB estimation.

FIGS. 7 and 8 show additional details of a method for FCB estimation that may be modified to include adaptive formant sharpening as described herein. FIG. 7 illustrates generation of a target signal x(n) for adaptive codebook search by applying the weighted synthesis filter to a prediction error that is based on preprocessed speech signal s(n) and the excitation signal obtained at the end of the previous subframe.

In FIG. 8, the impulse response h(n) of the weighted synthesis filter is convolved with the ACB vector v(n) to produce ACB component y(n). The ACB component y(n) is weighted by $g_p$ to produce an ACB contribution that is subtracted from the target signal x(n) to produce a modified target signal $x'(n)$ for FCB search, which may be performed, for example, to find the index location, k, of the FCB pulse that maximizes the search term shown in FIG. 8 (e.g., as described in section 5.8.3 of TS 26.190 V11.0.0).

Figure 9:
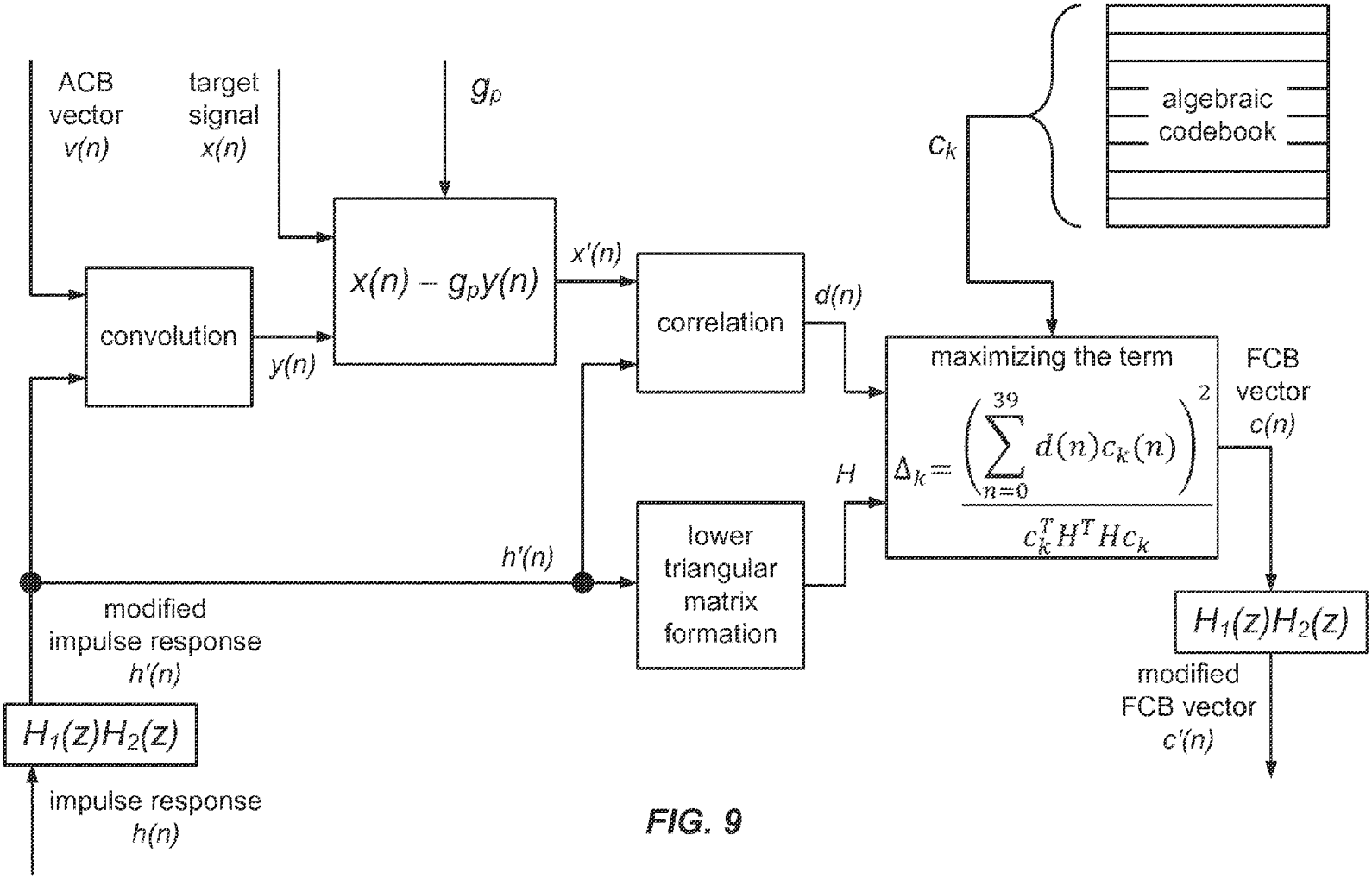
FIG. 9 shows a modification of the method of FIG. 8 to include adaptive formant sharpening as described herein.

FIG. 9 shows a modification of the FCB estimation procedure shown in FIG. 8 to include adaptive formant sharpening as described herein. In this case, the filters $H_1(z)$ and $H_2(z)$ are applied to the impulse response h(n) of the weighted synthesis filter to produce the modified impulse response h'(n). These filters are also applied to the FCB (or "algebraic codebook") vectors after the search.

The decoder may be implemented to apply the filters $H_1(z)$ and $H_2(z)$ to the FCB vector as well. In one such example, the encoder is implemented to transmit the calculated FS factor to the decoder as a parameter of the encoded frame. This implementation may be used to control the extent of formant sharpening in the decoded signal. In another such example, the decoder is implemented to generate the filters $H_1(z)$ and $H_2(z)$ based on a long-term SNR estimate that may be locally generated (e.g., as described herein with reference to the pseudocode listings in FIGS. 4 and 5), such that no additional transmitted information is required. It is possible in this case, however, that the SNR estimates at the encoder and decoder may become unsynchronized due to, for example, a large burst of frame erasures at the decoder. It may be desirable to proactively address such a potential SNR drift by performing a synchronous and periodic reset of the long-term SNR estimate (e.g., to the current instantaneous SNR) at the encoder and decoder. In one example, such a reset is performed at a regular interval (e.g., every five seconds, or every 250 frames). In another example, such a reset is performed at the onset of a speech segment that occurs after a long period of inactivity (e.g., a time period of at least two seconds, or a sequence of at least 100 consecutive inactive frames).

Figure 10A:
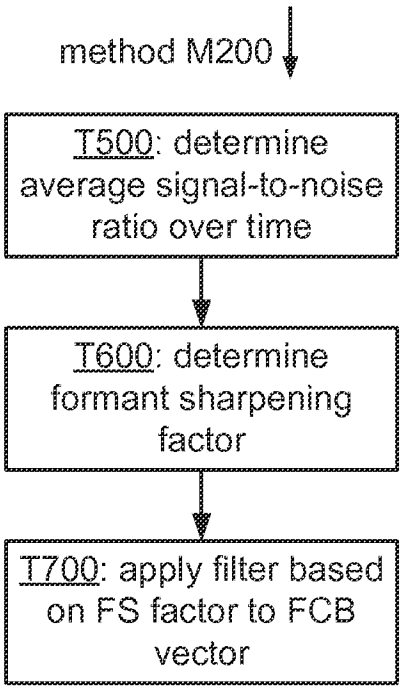
FIG. 10A shows a flowchart for a method M200 for processing an encoded audio signal according to a general configuration.

FIG. 10A shows a flowchart for a method M200 of processing an encoded audio signal according to a general configuration that includes tasks T500, T600, and T700. Task T500 determines (e.g., calculates) an average signal-to-noise ratio over time (e.g., as described herein with reference to task T100), based on information from a first frame of the encoded audio signal. Task T600 determines (e.g., calculates) a formant-sharpening factor, based on the average signal-to-noise ratio (e.g., as described herein with reference to task T200). Task T700 applies a filter that is based on the formant-sharpening factor (e.g., $H_2(z)$ or $H_1(z)$ $H_2(z)$ as described herein) to a codebook vector that is based on information from a second frame of the encoded audio signal (e.g., an FCB vector). Such a method may be performed within, for example, a portable communications device, such as a cellular telephone.

Figure 10B:
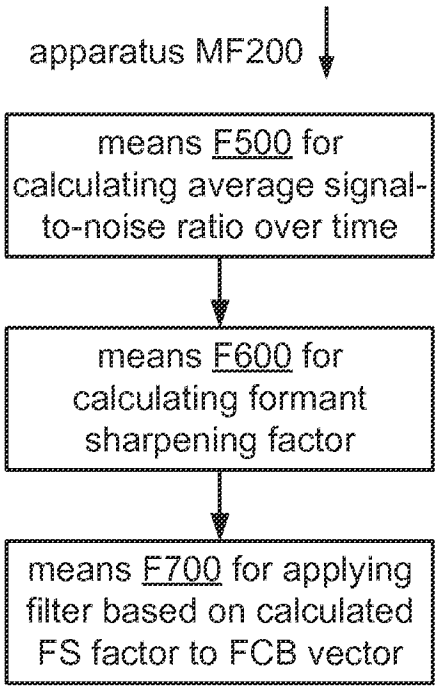
FIG. 10B shows a block diagram for an apparatus MF200 for processing an encoded audio signal according to a general configuration.

FIG. 10B shows a block diagram of an apparatus MF200 for processing an encoded audio signal according to a general configuration. Apparatus MF200 includes means F500 for calculating an average signal-to-noise ratio over time (e.g., as described herein with reference to task T100), based on information from a first frame of the encoded audio signal. Apparatus MF200 also includes means F600 for calculating a formant-sharpening factor, based on the calculated average signal-to-noise ratio (e.g., as described herein with reference to task T200). Apparatus MF200 also includes means F700 for applying a filter that is based on the calculated formant-sharpening factor (e.g., $H_2(z)$ or 14(z) $H_2(z)$ as described herein) to a codebook vector that is based on information from a second frame of the encoded audio signal (e.g., an FCB vector). Such an apparatus may be implemented within, for example, a portable communications device, such as a cellular telephone.

Figure 10C:
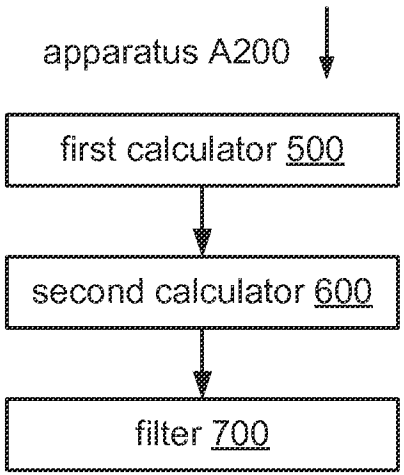
FIG. 10C shows a block diagram for an apparatus A200 for processing an encoded audio signal according to a general configuration.

FIG. 10C shows a block diagram of an apparatus A200 for processing an encoded audio signal according to a general configuration. Apparatus A200 includes a first calculator 500 configured to determine an average signal-to-noise ratio over time (e.g., as described herein with reference to task T100), based on information from a first frame of the encoded audio signal. Apparatus A200 also includes a second calculator 600 configured to determine a formant-sharpening factor, based on the average signal-to-noise ratio (e.g., as described herein with reference to task T200). Apparatus A200 also includes a filter 700 that is based on the formant-sharpening factor (e.g., $H_2(z)$ or $H_2(z)H_2(z)$ as described herein) and is arranged to filter a codebook vector that is based on information from a second frame of the encoded audio signal (e.g., an FCB vector). Such an apparatus may be implemented within, for example, a portable communications device, such as a cellular telephone.

Figure 11A:
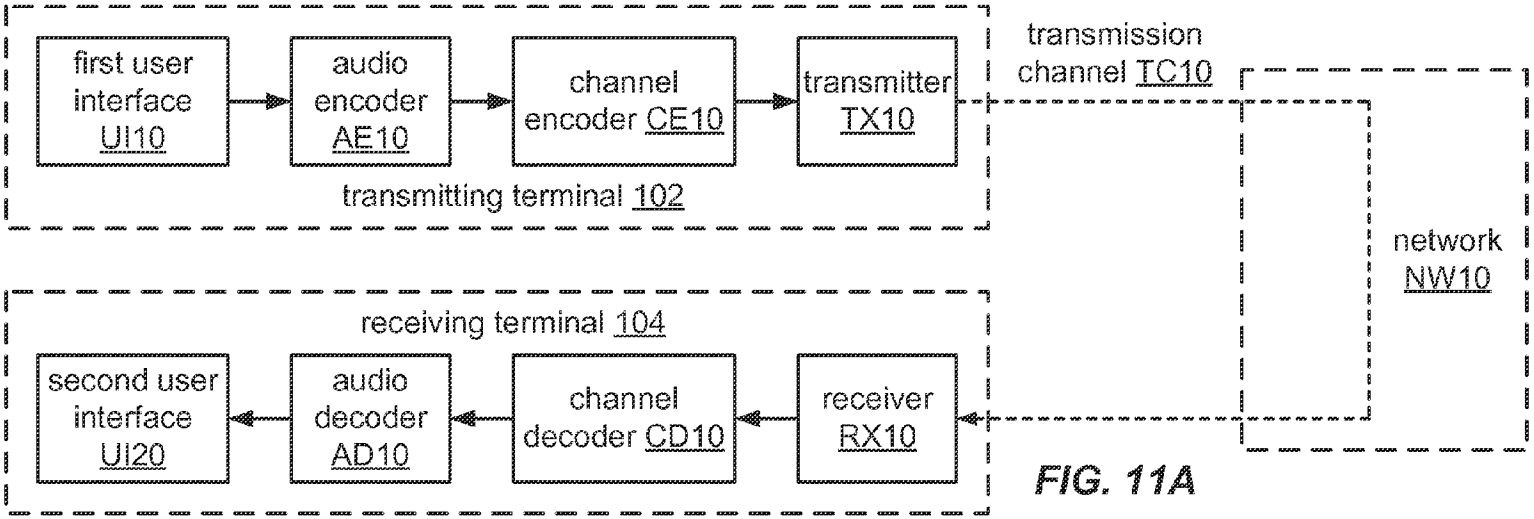
FIG. 11A is a block diagram illustrating an example of a transmitting terminal 102 and a receiving terminal 104 that communicate over network NW10.

FIG. 11A is a block diagram illustrating an example of a transmitting terminal 102 and a receiving terminal 104 that communicate over a network NW10 via transmission channel TC10. Each of terminals 102 and 104 may be implemented to perform a method as described herein and/or to include an apparatus as described herein. The transmitting and receiving terminals 102, 104 may be any devices that are capable of supporting voice communications, including telephones (e.g., smartphones), computers, audio broadcast and receiving equipment, video conferencing equipment, or the like. The transmitting and receiving terminals 102, 104 may be implemented, for example, with wireless multiple access technology, such as Code Division Multiple Access (CDMA) capability. CDMA is a modulation and multiple-access scheme based on spread-spectrum communications.

Transmitting terminal 102 includes an audio encoder AE10, and receiving terminal 104 includes an audio decoder AD10. Audio encoder AE10, which may be used to compress audio information (e.g., speech) from a first user interface UI10 (e.g., a microphone and audio front-end) by extracting values of parameters according to a model of human speech generation, may be implemented to perform a method as described herein. A channel encoder CE10 assembles the parameter values into packets, and a transmitter TX10 transmits the packets including these parameter values over network NW10, which may include a packet-based network, such as the Internet or a corporate intranet, via transmission channel TC10. Transmission channel TC10 may be a wired and/or wireless transmission channel and may be considered to extend to an entry point of network NW10 (e.g., a base station controller), to another entity within network NW10 (e.g., a channel quality analyzer), and/or to a receiver RX10 of receiving terminal 104, depending upon how and where the quality of the channel is determined.

A receiver RX10 of receiving terminal 104 is used to receive the packets from network NW10 via a transmission channel. A channel decoder CD10 decodes the packets to obtain the parameter values, and an audio decoder AD10 synthesizes the audio information using the parameter values from the packets (e.g., according to a method as described herein). The synthesized audio (e.g., speech) is provided to a second user interface UI20 (e.g., an audio output stage and loudspeaker) on the receiving terminal 104. Although not shown, various signal processing functions may be performed in channel encoder CE10 and channel decoder CD10 (e.g., convolutional coding including cyclic redundancy check (CRC) functions, interleaving) and in transmitter TX10 and receiver RX10 (e.g., digital modulation and corresponding demodulation, spread spectrum processing, analog-to-digital and digital-to-analog conversion).

Each party to a communication may transmit as well as receive, and each terminal may include instances of audio encoder AE10 and decoder AD10. The audio encoder and decoder may be separate devices or integrated into a single device known as a "voice coder" or "vocoder." As shown in FIG. 11A, the terminals 102, 104 are described with an audio encoder AE10 at one terminal of network NW10 and an audio decoder AD10 at the other.

In at least one configuration of transmitting terminal 102, an audio signal (e.g., speech) may be input from first user interface UI10 to audio encoder AE10 in frames, with each frame further partitioned into sub-frames. Such arbitrary frame boundaries may be used where some block processing is performed. However, such partitioning of the audio samples into frames (and sub-frames) may be omitted if continuous processing rather than block processing is implemented. In the described examples, each packet transmitted across network NW10 may include one or more frames depending on the specific application and the overall design constraints.

Audio encoder AE10 may be a variable-rate or single-fixed-rate encoder. A variable-rate encoder may dynamically switch between multiple encoder modes (e.g., different fixed rates) from frame to frame, depending on the audio content (e.g., depending on whether speech is present and/or what type of speech is present). Audio decoder AD10 may also dynamically switch between corresponding decoder modes from frame to frame in a corresponding manner. A particular mode may be chosen for each frame to achieve the lowest bit rate available while maintaining acceptable signal reproduction quality at receiving terminal 104.

Audio encoder AE10 typically processes the input signal as a series of nonoverlapping segments in time or "frames," with a new encoded frame being calculated for each frame. The frame period is generally a period over which the signal may be expected to be locally stationary; common examples include twenty milliseconds (equivalent to 320 samples at a sampling rate of 16 kHz, 256 samples at a sampling rate of 12.8 kHz, or 160 samples at a sampling rate of eight kHz) and ten milliseconds. It is also possible to implement audio encoder AE10 to process the input signal as a series of overlapping frames.

Figure 11B:
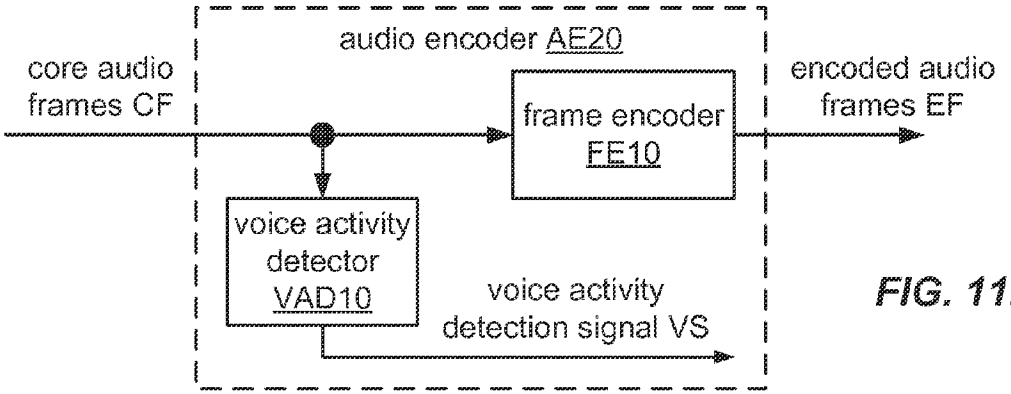
FIG. 11B shows a block diagram of an implementation AE20 of audio encoder AE10.

FIG. 11B shows a block diagram of an implementation AE20 of audio encoder AE10 that includes a frame encoder FE10. Frame encoder FE10 is configured to encode each of a sequence of frames CF of the input signal ("core audio frames") to produce a corresponding one of a sequence of encoded audio frames EF. Audio encoder AE10 may also be implemented to perform additional tasks such as dividing the input signal into the frames and selecting a coding mode for frame encoder FE10 (e.g., selecting a reallocation of an initial bit allocation, as described herein with reference to task T400). Selecting a coding mode (e.g., rate control) may include performing voice activity detection (VAD) and/or otherwise classifying the audio content of the frame. In this example, audio encoder AE20 also includes a voice activity detector VAD10 that is configured to process the core audio frames CF to produce a voice activity detection signal VS (e.g., as described in 3GPP TS 26.194 v11.0.0, September 2012, available at ETSI).

Frame encoder FE10 is implemented to perform a codebook-based scheme (e.g., codebook excitation linear prediction or CELP) according to a source-filter model that encodes each frame of the input audio signal as (A) a set of parameters that describe a filter and (B) an excitation signal that will be used at the decoder to drive the described filter to produce a synthesized reproduction of the audio frame. The spectral envelope of a speech signal is typically characterized by peaks that represent resonances of the vocal tract (e.g., the throat and mouth) and are called formants. Most speech coders encode at least this coarse spectral structure as a set of parameters, such as filter coefficients. The remaining residual signal may be modeled as a source (e.g., as produced by the vocal chords) that drives the filter to produce the speech signal and typically is characterized by its intensity and pitch.

Particular examples of encoding schemes that may be used by frame encoder FE10 to produce the encoded frames EF include, without limitation, G.726, G.728, G.729A, AMR, AMR-WB, AMR-WB+ (e.g., as described in 3GPP TS 26.290 v11.0.0, September 2012 (available from ETSI)), VMR-WB (e.g., as described in the Third Generation Partnership Project 2 (3GPP2) document C.S0052-A v1.0, April 2005 (available online at www-dot-3gpp2-dot-org)), the Enhanced Variable Rate Codec (EVRC, as described in the 3GPP2 document C.S0014-E v1.0, December 2011 (available online at www-dot-3gpp2-dot-org)), the Selectable Mode Vocoder speech codec (as described in the 3GPP2 document C.S0030-0,v3.0, January 2004 (available online at www-dot-3gpp2-dot-org)), and the Enhanced Voice Service codec (EVS, e.g., as described in 3GPP TR 22.813 v10.0.0 (March 2010), available from ETSI).

Figure 12:
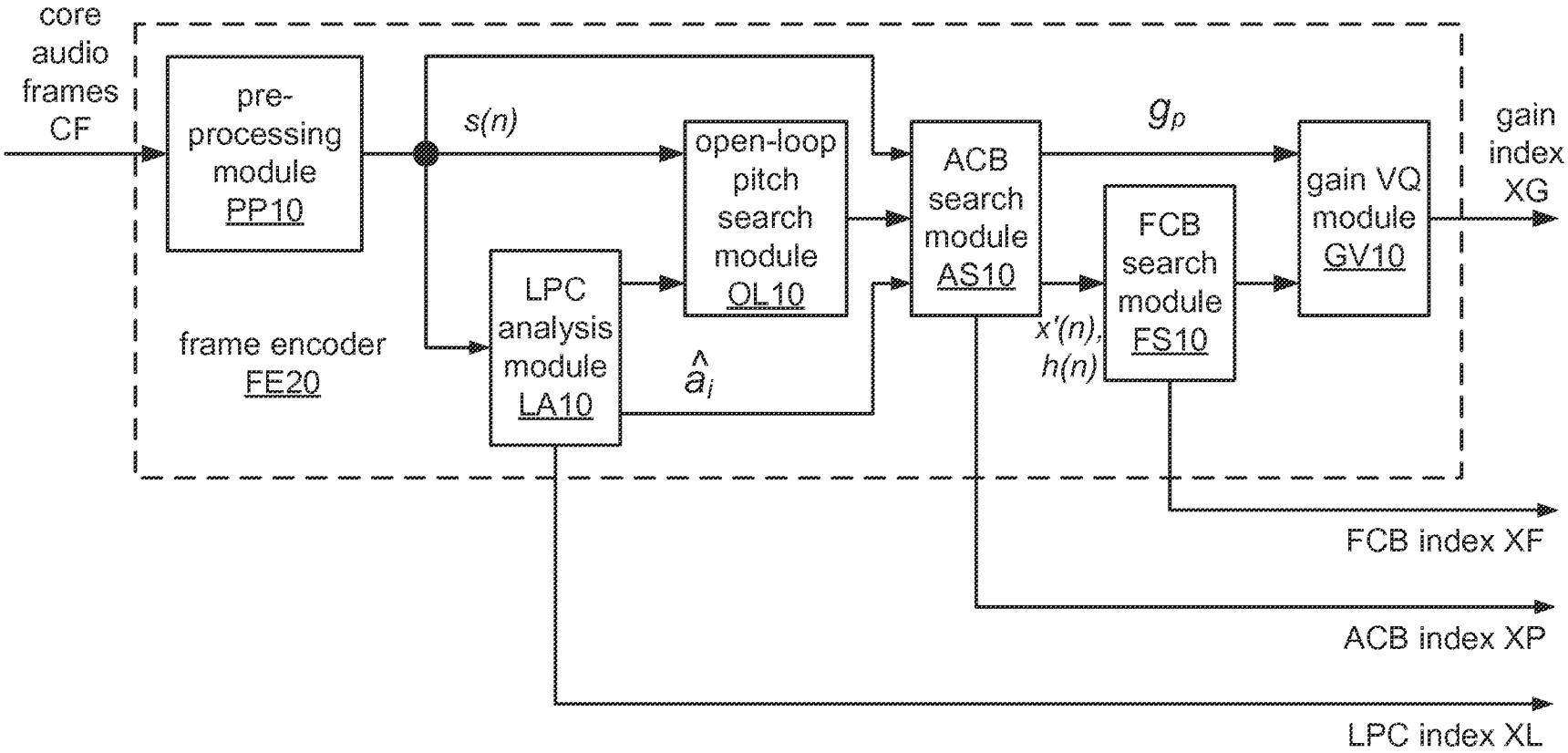
FIG. 12 shows a block diagram of a basic implementation FE20 of frame encoder FE10.

FIG. 12 shows a block diagram of a basic implementation FE20 of frame encoder FE10 that includes a preprocessing module PP10, a linear prediction coding (LPC) analysis module LA10, an open-loop pitch search module OL10, an adaptive codebook (ACB) search module AS10, a fixed codebook (FCB) search module FS10, and a gain vector quantization (VQ) module GV10. Preprocessing module PP10 may be implemented, for example, as described in section 5.1 of 3GPP TS 26.190 v11.0.0. In one such example, preprocessing module PP10 is implemented to perform downsampling of the core audio frame (e.g., from 16 kHz to 12.8 kHz), high-pass filtering of the downsampled frame (e.g., with a cutoff frequency of 50 Hz), and pre-emphasis of the filtered frame (e.g., using a first-order highpass filter).

Linear prediction coding (LPC) analysis module LA10 encodes the spectral envelope of each core audio frame as a set of linear prediction (LP) coefficients (e.g., coefficients of the all-pole filter 1/A(z) as described above). In one example, LPC analysis module LA10 is configured to calculate a set of sixteen LP filter coefficients to characterize the formant structure of each 20-millisecond frame. Analysis module LA10 may be implemented, for example, as described in section 5.2 of 3GPP TS 26.190 v11.0.0.

Analysis module LA10 may be configured to analyze the samples of each frame directly, or the samples may be weighted first according to a windowing function (for example, a Hamming window). The analysis may also be performed over a window that is larger than the frame, such as a 30-msec window. This window may be symmetric (e.g. 5-20-5, such that it includes the 5 milliseconds immediately before and after the 20-millisecond frame) or asymmetric (e.g. 10-20, such that it includes the last 10 milliseconds of the preceding frame). An LPC analysis module is typically configured to calculate the LP filter coefficients using a Levinson-Durbin recursion or the Leroux-Gueguen algorithm. Although LPC encoding is well suited to speech, it may also be used to encode generic audio signals (e.g., including non-speech, such as music). In another implementation, the analysis module may be configured to calculate a set of cepstral coefficients for each frame instead of a set of LP filter coefficients.

Linear prediction filter coefficients are typically difficult to quantize efficiently and are usually mapped into another representation, such as line spectral pairs (LSPs) or line spectral frequencies (LSFs), or immittance spectral pairs (ISPs) or immittance spectral frequencies (ISFs), for quantization and/or entropy encoding. In one example, analysis module LA10 transforms the set of LP filter coefficients into a corresponding set of ISFs. Other one-to-one representations of LP filter coefficients include parcor coefficients and log-area-ratio values. Typically a transform between a set of LP filter coefficients and a corresponding set of LSFs, LSPs, ISFs, or ISPs is reversible, but embodiments also include implementations of analysis module LA10 in which the transform is not reversible without error.

Analysis module LA10 is configured to quantize the set of ISFs (or LSFs or other coefficient representation), and frame encoder FE20 is configured to output the result of this quantization as LPC index XL. Such a quantizer typically includes a vector quantizer that encodes the input vector as an index to a corresponding vector entry in a table or codebook. Module LA10 is also configured to provide the quantized coefficients $\hat{a}_i$ for calculation of the weighted synthesis filter as described herein (e.g., by ACB search module AS10).

Frame encoder FE20 also includes an optional open-loop pitch search module OL10 that may be used to simplify pitch analysis and reduce the scope of the closed-loop pitch search in adaptive codebook search module AS10. Module OL10 may be implemented to filter the input signal through a weighting filter that is based on the unquantized LP filter coefficients, to decimate the weighted signal by two, and to produce a pitch estimate once or twice per frame (depending on the current rate). Module OL10 may be implemented, for example, as described in section 5.4 of 3GPP TS 26.190 v11.0.0.

Adaptive codebook (ACB) search module AS10 is configured to search the adaptive codebook (based on the past excitation and also called the "pitch codebook") to produce the delay and gain of the pitch filter. Module AS10 may be implemented to perform closed-loop pitch search around the open-loop pitch estimates on a subframe basis on a target signal (as obtained, e.g., by filtering the LP residual through a weighted synthesis filter based on the quantized and unquantized LP filter coefficients) and then to compute the adaptive codevector by interpolating the past excitation at the indicated fractional pitch lag and to compute the ACB gain. Module AS10 may also be implemented to use the LP residual to extend the past excitation buffer to simplify the closed-loop pitch search (especially for delays less than the subframe size of, e.g., 40 or 64 samples). Module AS10 may be implemented to produce an ACB gain $g_p$ (e.g., for each subframe) and a quantized index that indicates the pitch delay of the first subframe (or the pitch delays of the first and third subframes, depending on the current rate) and relative pitch delays of the other subframes. Module AS10 may be implemented, for example, as described in section 5.7 of 3GPP TS 26.190 v11.0.0. In the example of FIG. 12, module AS10 provides the modified target signal x'(n) and the modified impulse response h'(n) to FCB search module FS10.

Fixed codebook (FCB) search module FS10 is configured to produce an index that indicates a vector of the fixed codebook (also called "innovation codebook," "innovative codebook," "stochastic codebook," or "algebraic codebook"), which represents the portion of the excitation that is not modeled by the adaptive codevector. Module FS10 may be implemented to produce the codebook index as a codeword that contains all of the information needed to reproduce the FCB vector c(n) (e.g., represents the pulse positions and signs), such that no codebook is needed. Module FS10 may be implemented, for example, as described in FIG. 8 herein and/or in section 5.8 of 3GPP TS 26.190 v11.0.0. In the example of FIG. 12, module FS10 is also configured to apply the filters $H_1(z)H_2(z)$ to c(n) (e.g., before calculation of the excitation signal e(n) for the subframe, where $e(n)=g_p v(n)+g_c c'(n)$).

Gain vector quantization module GV10 is configured to quantize the FCB and ACB gains, which may include gains for each subframe. Module GV10 may be implemented, for example, as described in section 5.9 of 3GPP TS 26.190 v11.0.0

Figure 13A:
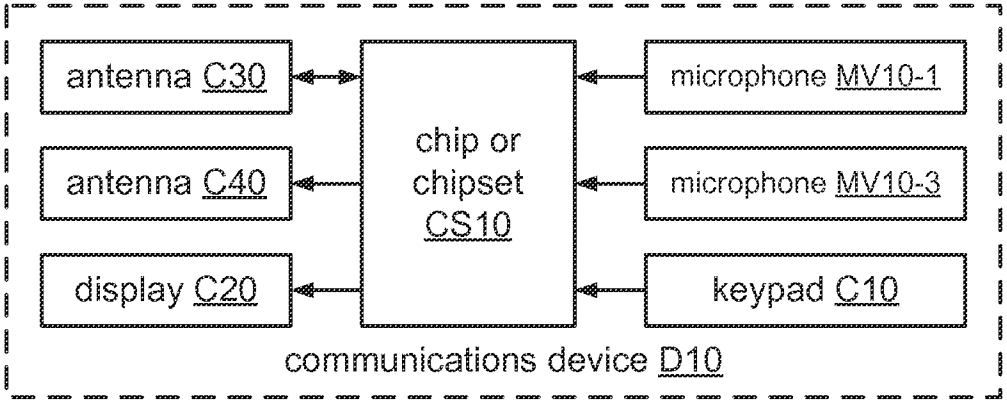
FIG. 13A shows a block diagram of a communications device D10.

FIG. 13A shows a block diagram of a communications device D10 that includes a chip or chipset CS10 (e.g., a mobile station modem (MSM) chipset) that embodies the elements of apparatus A100 (or MF100). Chip/chipset CS10 may include one or more processors, which may be configured to execute a software and/or firmware part of apparatus A100 or MF100 (e.g., as instructions). Transmitting terminal 102 may be realized as an implementation of device D10.

Chip/chipset CS10 includes a receiver (e.g., RX10), which is configured to receive a radio-frequency (RF) communications signal and to decode and reproduce an audio signal encoded within the RF signal, and a transmitter (e.g., TX10), which is configured to transmit an RF communications signal that describes an encoded audio signal (e.g., as produced using method M100). Such a device may be configured to transmit and receive voice communications data wirelessly via any one or more of the codecs referenced herein.

Device D10 is configured to receive and transmit the RF communications signals via an antenna C30. Device D10 may also include a diplexer and one or more power amplifiers in the path to antenna C30. Chip/chipset CS10 is also configured to receive user input via keypad C10 and to display information via display C20. In this example, device D10 also includes one or more antennas C40 to support Global Positioning System (GPS) location services and/or short-range communications with an external device such as a wireless (e.g., Bluetooth™) headset. In another example, such a communications device is itself a Bluetooth™ headset and lacks keypad C10, display C20, and antenna C30.

Figure 14:
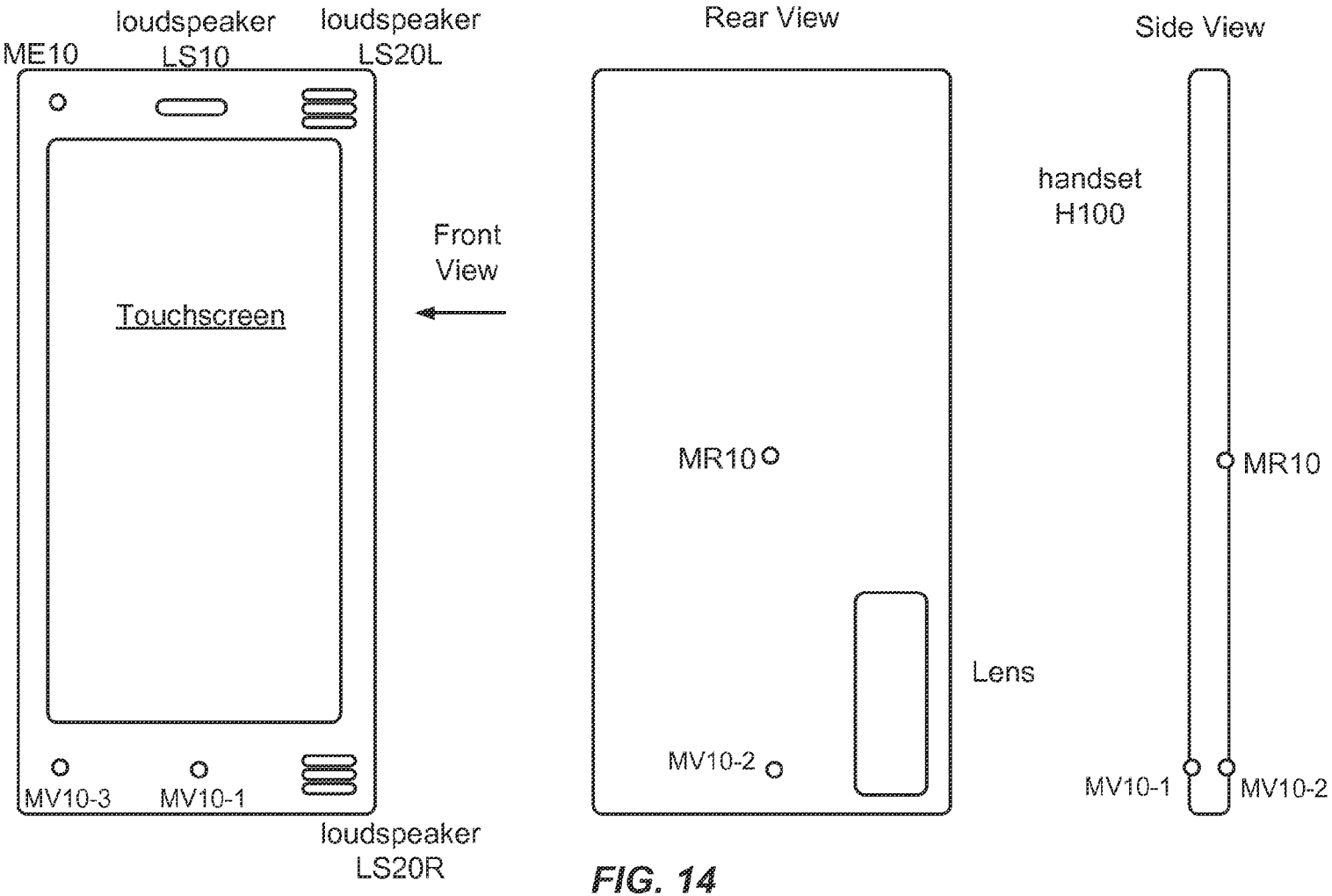
FIG. 14 shows front, rear, and side views of a handset H100.

Communications device D10 may be embodied in a variety of communications devices, including smartphones and laptop and tablet computers. FIG. 14 shows front, rear, and side views of one such example: a handset H100 (e.g., a smartphone) having two voice microphones MV10-1 and MV10-3 arranged on the front face, a voice microphone MV10-2 arranged on the rear face, another microphone ME10 (e.g., for enhanced directional selectivity and/or to capture acoustic error at the user's ear for input to an active noise cancellation operation) located in a top corner of the front face, and another microphone MR10 (e.g., for enhanced directional selectivity and/or to capture a background noise reference) located on the back face. A loudspeaker LS10 is arranged in the top center of the front face near error microphone ME10, and two other loudspeakers LS20L, LS20R are also provided (e.g., for speakerphone applications). A maximum distance between the microphones of such a handset is typically about ten or twelve centimeters.

Figure 13B:
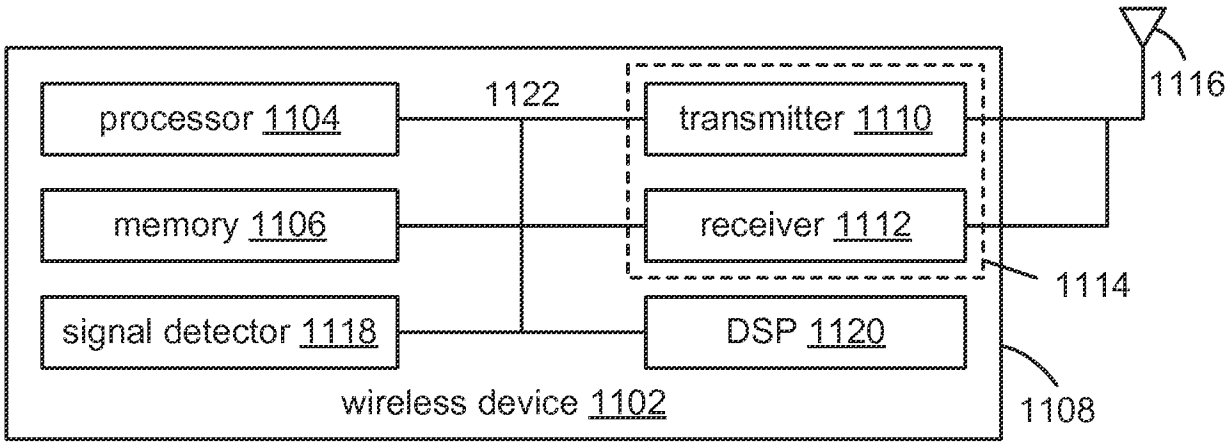
FIG. 13B shows a block diagram of a wireless device 1102.

FIG. 13B shows a block diagram of a wireless device 1102 may be implemented to perform a method as described herein. Transmitting terminal 102 may be realized as an implementation of wireless device 1102. Wireless device 1102 may be a remote station, access terminal, handset, personal digital assistant (PDA), cellular telephone, etc.

Wireless device 1102 includes a processor 1104 which controls operation of the device. Processor 1104 may also be referred to as a central processing unit (CPU). Memory 1106, which may include both read-only memory (ROM) and random access memory (RAM), provides instructions and data to processor 1104. A portion of memory 1106 may also include non-volatile random access memory (NVRAM). Processor 1104 typically performs logical and arithmetic operations based on program instructions stored within memory 1106. The instructions in memory 1106 may be executable to implement the method or methods as described herein.

Wireless device 1102 includes a housing 1108 that may include a transmitter 1110 and a receiver 1112 to allow transmission and reception of data between wireless device 1102 and a remote location. Transmitter 1110 and receiver 1112 may be combined into a transceiver 1114. An antenna 1116 may be attached to the housing 1108 and electrically coupled to the transceiver 1114. Wireless device 1102 may also include (not shown) multiple transmitters, multiple receivers, multiple transceivers and/or multiple antennas.

In this example, wireless device 1102 also includes a signal detector 1118 that may be used to detect and quantify the level of signals received by transceiver 1114. Signal detector 1118 may detect such signals as total energy, pilot energy per pseudonoise (PN) chips, power spectral density, and other signals. Wireless device 1102 also includes a digital signal processor (DSP) 1120 for use in processing signals.

The various components of wireless device 1102 are coupled together by a bus system 1122 which may include a power bus, a control signal bus, and a status signal bus in addition to a data bus. For the sake of clarity, the various busses are illustrated in FIG. 13B as the bus system 1122.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 32, 44.1, 48, or 192 kHz).

An apparatus as disclosed herein (e.g., apparatus A100, A200, MF100, MF200) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., apparatus A100, A200, MF100, MF200) may be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of method M100, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., implementations of method M100 or M200) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk or any other medium which can be used to store the desired information, a fiber optic medium, a radio frequency (RF) link, or any other medium which can be used to carry the desired information and can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or that may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of processing an audio signal, the method comprising:

determining a parameter associated with the audio signal, wherein the parameter corresponds to a voicing factor, a coding mode, or a pitch lag, the audio signal received at an audio coder;

based on the determined parameter, determining a formant-sharpening factor; and applying a filter that is based on the determined formant-sharpening factor to a codebook vector that is based on information from the audio signal to generate a filtered codebook vector, wherein the codebook vector comprises a sequence of unitary pulses, and wherein the filtered codebook vector is used to generate a synthesized audio signal.

2. The method of claim 1, wherein the parameter corresponds to the voicing factor and indicates at least one of a strongly voiced segment or a weakly voiced segment.

3. The method of claim 2, wherein the voicing factor indicates the strongly voiced segment.

4. The method of claim 2, wherein the voicing factor indicates the weakly voiced segment.

5. The method of claim 1, wherein the parameter corresponds to the coding mode and indicates at least one of music, silence, a transient frame, a voiced frame, or an unvoiced frame.

6. The method of claim 5, wherein the coding mode indicates music.

7. The method of claim 5, wherein the coding mode indicates silence.

8. The method of claim 5, wherein the coding mode indicates the transient frame.

9. The method of claim 5, wherein the coding mode indicates the unvoiced frame.

10. The method of claim 1, further comprising determining an average signal-to-noise ratio for the audio signal over time.

11. The method of claim 1, further comprising:

performing a linear prediction coding analysis on the audio signal to obtain a plurality of linear prediction filter coefficients; and applying the filter to an impulse response of a weighted synthesis filter that is based on the plurality of linear prediction filter coefficients to obtain a modified impulse response, wherein the weighted synthesis filter includes a feedforward weight and a feedback weight, and wherein the feedforward weight is greater than the feedback weight; and based on the modified impulse response, selecting the codebook vector from among a plurality of algebraic codebook vectors.

12. The method of claim 1, wherein the filter includes a formant-sharpening filter that is based on the determined formant-sharpening factor and a pitch-sharpening filter that is based on a pitch estimate of at least a portion of the audio signal.

13. The method of claim 1, further comprising sending an indication of the formant-sharpening factor with an encoded version of the audio signal to a decoder.

14. The method of claim 13, wherein the indication of the formant sharpening factor is included in a frame of the encoded version of the audio signal.

15. The method of claim 1, further comprising adjusting a signal-to-noise estimate of the audio signal according to an adjustment criterion.

16. The method of claim 15, wherein the adjustment criterion comprises a time period.

17. The method of claim 1, wherein determining the parameter associated with the audio signal is performed within a device that comprises a mobile communication device.

18. The method of claim 1, wherein the parameter corresponds to the pitch lag.

19. The method of claim 1, wherein applying the filter is performed by a device, and wherein the device comprises a mobile communication device.

20. The method of claim 1, wherein applying the filter is performed by a device, and wherein the device comprises a base station.

21. The method of claim 1, further comprising:

generating an excitation signal based on the filtered codebook vector; and generating the synthesized audio signal based on the excitation signal.

22. The method of claim 1, further comprising receiving the audio signal via a microphone or an antenna of a mobile device.

23. The method of claim 1, further comprising, prior to applying the filter that is based on the determined formant-sharpening factor to the codebook vector, applying a second filter that is based on the determined formant-sharpening factor to an impulse response of a synthesis filter to generate a filtered impulse response.

24. The method of claim 23, wherein the synthesis filter comprises a weighted synthesis filter.

25. The method of claim 23, wherein the second filter is further based on a pitch-sharpening factor.

26. The method of claim 23, further comprising determining the codebook vector based on the filtered impulse response.

27. The method of claim 26, wherein determining the codebook vector includes estimating the codebook vector by performing a search of a plurality of algebraic codebook vectors based on the filtered impulse response.

28. The method of claim 26, wherein the codebook vector is further determined based on a target signal.

29. The method of claim 28, further comprising generating the target signal based on applying the synthesis filter to a prediction error.

30. The method of claim 29, wherein the prediction error is based on the audio signal and on an excitation signal associated with a previous sub-frame.

31. An apparatus comprising:

an audio coder input configured to receive an audio signal;

a first calculator configured to determine a parameter associated with the audio signal, wherein the parameter corresponds to a voicing factor, a coding mode, or a pitch lag;

a second calculator configured to determine a formant-sharpening factor based on the determined parameter; and a filter that is based on the determined formant-sharpening factor, wherein the filter is arranged to filter a codebook vector, and wherein the codebook vector is based on information from the audio signal to generate a filtered codebook vector, wherein the codebook vector comprises a sequence of unitary pulses, and wherein the filtered codebook vector is used to generate a synthesized audio signal.

32. The apparatus of claim 31, further comprising:

an antenna; and a receiver coupled to the antenna and to the audio coder input.

33. The apparatus of claim 32, wherein the receiver, the first calculator, the second calculator, and the filter are integrated into a mobile communication device.

34. The apparatus of claim 32, wherein the receiver, the first calculator, the second calculator, and the filter are integrated into a base station.

35. The apparatus of claim 31, further comprising a linear prediction analyzer configured to perform a linear prediction coding analysis on the audio signal to generate a plurality of linear prediction filter coefficients.

36. The apparatus of claim 35, further comprising a selector configured to select the codebook vector from among a plurality of algebraic codebook vectors based on an adaptive codebook vector.

37. The apparatus of claim 31, further comprising a transmitter configured to send an indication of the formant-sharpening factor with an encoded version of the audio signal to a decoder.

38. The apparatus of claim 31, wherein the filter is further configured to output the filtered codebook vector.

39. The apparatus of claim 31, further comprising a coder configured to:

generate an excitation signal based on the filtered codebook vector; and generate the synthesized audio signal based on the excitation signal.

40. The apparatus of claim 31, further comprising a synthesis filter configured to generate an impulse response.

41. The apparatus of claim 40, wherein the synthesis filter comprises a weighted synthesis filter.

42. The apparatus of claim 40, further comprising a second filter that is based on the determined formant-sharpening factor, wherein the second filter is arranged to filter the impulse response to generate a filtered impulse response.

43. The apparatus of claim 42, wherein the second filter is further based on a pitch-sharpening factor.

44. The apparatus of claim 42, further comprising a selector configured to select the codebook vector from among a plurality of algebraic codebook vectors based on the filtered impulse response.

45. A method of processing an encoded audio signal, the method comprising:

receiving the encoded audio signal at an audio coder;

based on a parameter of a frame of the encoded audio signal, determining a formant-sharpening factor, wherein the parameter corresponds to a voicing factor, a coding mode, or a pitch lag; and applying a filter that is based on the determined formant-sharpening factor to a codebook vector that is based on information from the encoded audio signal to generate a filtered codebook vector, wherein the codebook vector comprises a sequence of unitary pulses, and wherein the filtered codebook vector is used to generate a synthesized audio signal.

46. The method of claim 45, wherein the parameter corresponds to the voicing factor and indicates at least one of a strongly voiced segment or a weakly voiced segment.

47. The method of claim 45, wherein the parameter corresponds to the coding mode and indicates at least one of music, silence, a transient frame, a voiced frame, or an unvoiced frame.

48. The method of claim 45, wherein applying the filter is performed by a device, and wherein the device comprises a mobile communication device.

49. The method of claim 45, wherein applying the filter is performed by a device, and wherein the device comprises a base station.

50. The method of claim 45, further comprising:

generating an excitation signal based on the filtered codebook vector; and generating the synthesized audio signal based on the excitation signal.

51. An apparatus comprising:

an audio coder input configured to receive an encoded audio signal;

a calculator configured to determine a formant-sharpening factor based on a parameter of a frame of the encoded audio signal, wherein the parameter corresponds to a voicing factor, a coding mode, or a pitch lag; and a filter that is based on the determined formant-sharpening factor, wherein the filter is arranged to filter a codebook vector, and wherein the codebook vector is based on information from the encoded audio signal to generate a filtered codebook vector, wherein the codebook vector comprises a sequence of unitary pulses, and wherein the filtered codebook vector is used to generate a synthesized audio signal.

52. The apparatus of claim 51, further comprising:

an antenna; and a receiver coupled to the antenna and to the audio coder input.

53. The apparatus of claim 52, wherein the receiver, the calculator, and the filter are integrated into a mobile communication device.

54. The apparatus of claim 52, wherein the receiver, the calculator, and the filter are integrated into a base station.

55. A computer-readable storage device storing instructions that, when executed by a processor, cause the processor to perforin operations comprising:

determining a parameter associated with an audio signal, wherein the parameter corresponds to a voicing factor, a coding mode, or a pitch lag, and wherein the audio signal is received at an audio coder;

determining a formant-sharpening factor based on the determined parameter; and applying a filter that is based on the determined formant-sharpening factor to a codebook vector that is based on information from the audio signal to generate a filtered codebook vector, wherein the codebook vector comprises a sequence of unitary pulses, and wherein the filtered codebook vector is used to generate a synthesized audio signal.

56. The computer-readable storage device of claim 55, wherein the parameter corresponds to the coding mode, and wherein the coding mode is associated with a particular bit rate.

57. The computer-readable storage device of claim 55, wherein the formant-sharpening factor is based on a noise estimation.

58. The computer-readable storage device of claim 57, wherein the operations further comprise:

tracking long term signal estimates during inactive segments of the audio signal; and generating the noise estimation based on the long term signal estimates.

59. The computer-readable storage device of claim 55, wherein the operations further comprise:

generating a plurality of linear prediction filter coefficients by performing a linear prediction coding analysis of the audio signal; and generating a modified impulse response by applying the filter to an impulse response of a second filter, wherein the second filter is based on the plurality of linear prediction filter coefficients.

60. The computer-readable storage device of claim 59, wherein the operations further comprise selecting the codebook vector based on the modified impulse response from a plurality of algebraic codebook vectors.

61. An apparatus comprising:

means for determining a parameter associated with an audio signal, the parameter corresponding to a voicing factor, a coding mode, or a pitch lag, wherein the audio signal is received at an audio coder input;

means for determining a formant-sharpening factor based on the determined parameter; and means for filtering a codebook vector based on the determined formant-sharpening factor, the codebook vector based on information from the audio signal to generate a filtered codebook vector, wherein the codebook vector comprises a sequence of unitary pulses, and wherein the filtered codebook vector is used to generate a synthesized audio signal.

62. The apparatus of claim 61, wherein the parameter corresponds to the coding mode, and wherein the coding mode is associated with a particular sampling rate.

63. The apparatus of claim 61, wherein the formant-sharpening factor is based on a noise estimation, wherein the means for determining the parameter comprises a first calculator, wherein the means for determining the formant-sharpening factor comprises a second calculator, and wherein the means for filtering the codebook vector comprises a filter.

64. The apparatus of claim 61, wherein the means for means for determining the parameter, the means for determining the formant-sharpening factor, and the means for filtering are integrated in a mobile communication device.

65. The apparatus of claim 61, wherein the means for means for determining the parameter, the means for determining the formant-sharpening factor, and the means for filtering are integrated in a base station.

66. A computer-readable storage device storing instructions that, when executed by a processor, cause the processor to perform operations comprising:

determining a formant-sharpening factor based on a parameter of a first frame of an encoded audio signal, the parameter corresponding to a voicing factor, a coding mode, or a pitch lag, wherein the encoded audio signal is received at an audio coder; and applying a filter that is based on the determined formant-sharpening factor to a codebook vector that is based on information from the encoded audio signal to generate a filtered codebook vector, wherein the codebook vector comprises a sequence of unitary pulses, and wherein the filtered codebook vector is used to generate a synthesized audio signal.

67. The computer-readable storage device of claim 66, wherein the parameter corresponds to the coding mode.

68. The computer-readable storage device of claim 66, wherein the operations further comprise generating a modified impulse response by applying the filter to an impulse response of a second filter, wherein the second filter is based on a plurality of linear prediction filter coefficients, and wherein the plurality of linear prediction filter coefficients are based on information from a second frame of the encoded audio signal.

69. The computer-readable storage device of claim 68, wherein the second filter includes a synthesis filter.

70. The computer-readable storage device of claim 68, wherein the second filter includes a weighted synthesis filter.

71. The computer-readable storage device of claim 70, wherein the weighted synthesis filter is based on a feedforward weight and a feedback weight, and wherein the feedforward weight is greater than the feedback weight.

72. An apparatus comprising:

means for determining a formant-sharpening factor based on a parameter of a frame of an encoded audio signal, the parameter corresponding to a voicing factor, a coding mode, or a pitch lag, wherein the encoded audio signal is received at an audio coder input; and means for filtering a codebook vector based on the determined formant-sharpening factor, the codebook vector based on information from the encoded audio signal to generate a filtered codebook vector, wherein the codebook vector comprises a sequence of unitary pulses, and wherein the filtered codebook vector is used to generate a synthesized audio signal.

73. The apparatus of claim 72, wherein the parameter corresponds to the coding mode, and wherein the coding mode is associated with a particular bit rate.

74. The apparatus of claim 72, wherein the means for determining and the means for filtering are integrated in a mobile communication device.

75. The apparatus of claim 72, wherein the means for determining and the means for filtering are integrated in a base station.

76. A method of processing an audio signal, the method comprising:

determining a parameter associated with the audio signal, wherein the parameter corresponds to a coding mode, the audio signal received at an audio coder;

determining a formant-sharpening factor based on the determined parameter; and applying a filter that is based on the determined formant-sharpening factor to a codebook vector that is based on information from the audio signal to generate a filtered codebook vector, wherein the codebook vector comprises a sequence of unitary pulses, and wherein the filtered codebook vector is used to generate a synthesized audio signal.

77. The method of claim 76, wherein the parameter indicates at least one of music, silence, a transient frame, a voiced frame, or an unvoiced frame.

78. The method of claim 76, wherein applying the filter includes applying a weighted filter based on a weight that corresponds to the formant-sharpening factor.

79. The method of claim 76, wherein the formant-sharpening factor is based on a noise estimation.

80. The method of claim 76, wherein applying the filter is performed by a device, and wherein the device comprises a mobile communication device.

81. The method of claim 76, wherein applying the filter is performed by a device, and wherein the device comprises a base station.

82. An apparatus comprising:

an audio coder input configured to receive an audio signal;

a first calculator configured to determine a parameter associated with the audio signal, wherein the parameter corresponds to a coding mode;

a second calculator configured to determine a formant-sharpening factor based on the determined parameter; and a filter that is based on the determined formant-sharpening factor, wherein the filter is arranged to filter a codebook vector, and wherein the codebook vector is based on information from the audio signal to generate a filtered codebook vector, wherein the codebook vector comprises a sequence of unitary pulses, and wherein the filtered codebook vector is used to generate a synthesized audio signal.

83. The apparatus of claim 82, wherein the coding mode is associated with a sampling rate of the audio signal.

84. The apparatus of claim 82, wherein the filter comprises:

a formant-sharpening filter that is based on the determined formant-sharpening factor; and a pitch-sharpening filter that is based on a pitch estimate of the audio signal.

85. The apparatus of claim 82, further comprising a transmitter configured to send an indication of the formant-sharpening factor as a parameter of a frame of an encoded version of the audio signal to a decoder.

86. The apparatus of claim 82, further comprising:

an antenna; and a receiver coupled to the antenna and to the audio coder input.

87. The apparatus of claim 86, wherein the receiver, the first calculator, the second calculator, and the filter are integrated into a mobile communication device.

88. The apparatus of claim 86, wherein the receiver, the first calculator, the second calculator, and the filter are integrated into a base station.

89. A method of processing an encoded audio signal, the method comprising:

receiving an encoded audio signal at an audio coder;

determining a formant-sharpening factor based on a parameter of a frame of the encoded audio signal, wherein the parameter corresponds to a coding mode; and applying a filter that is based on the determined formant-sharpening factor to a codebook vector that is based on information from the encoded audio signal to generate a filtered codebook vector, wherein the codebook vector comprises a sequence of unitary pulses, and wherein the filtered codebook vector is used to generate a synthesized audio signal.

90. The method of claim 89, wherein the coding mode is associated with a sampling rate of the encoded audio signal.

91. The method of claim 89, wherein the parameter indicates at least one of music, silence, a transient frame, a voiced frame, or an unvoiced frame.

92. The method of claim 89, wherein applying the filter is performed by a device, and wherein the device comprises a mobile communication device.

93. The method of claim 89, wherein applying the filter is performed by a device, and wherein the device comprises a base station.

94. An apparatus comprising:

an audio coder input configured to receive an encoded audio signal;

a calculator configured to determine a formant-sharpening factor based on a parameter of a frame of the encoded audio signal, wherein the parameter corresponds to a coding mode; and a filter that is based on the determined formant-sharpening factor, wherein the filter is arranged to filter a codebook vector, and wherein the codebook vector is based on information from the encoded audio signal to generate a filtered codebook vector, wherein the codebook vector comprises a sequence of unitary pulses, and wherein the filtered codebook vector is used to generate a synthesized audio signal.

95. The apparatus of claim 94, wherein the parameter indicates at least one of music, silence, a transient frame, a voiced frame, or an unvoiced frame.

96. The apparatus of claim 94, wherein the coding mode is associated with a particular bit rate.

97. The apparatus of claim 94, further comprising:

an antenna; and a receiver coupled to the antenna and to the audio coder input.

98. The apparatus of claim 97, wherein the receiver, the calculator, and the filter are integrated into a mobile communication device.

99. The apparatus of claim 97, wherein the receiver, the calculator, and the filter are integrated into a base station.

* * * * *